US009974155B2

(12) United States Patent
Stoltzfus et al.

(10) Patent No.: US 9,974,155 B2
(45) Date of Patent: May 15, 2018

(54) VARIABLE-PULSE-SHAPE PULSED-POWER ACCELERATOR

(71) Applicant: Sandia Corporation, Albuquerque, NM (US)

(72) Inventors: Brian S. Stoltzfus, Albuquerque, NM (US); Kevin Austin, Albuquerque, NM (US); Brian Thomas Hutsel, Sandia Park, NM (US); David Reisman, Albuquerque, NM (US); Mark E. Savage, Albuquerque, NM (US); William A. Stygar, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 479 days.

(21) Appl. No.: 14/833,993

(22) Filed: Aug. 24, 2015

(65) Prior Publication Data

US 2015/0366045 A1 Dec. 17, 2015

Related U.S. Application Data

(63) Continuation-in-part of application No. 14/451,209, filed on Aug. 4, 2014.

(Continued)

(51) Int. Cl.
*H05H 7/02* (2006.01)
*H05H 9/00* (2006.01)

(52) U.S. Cl.
CPC ..... *H05H 7/02* (2013.01); *H05H 9/005* (2013.01); *H05H 2007/022* (2013.01)

(58) Field of Classification Search
CPC ..... H05H 7/02

(Continued)

(56) References Cited

U.S. PATENT DOCUMENTS

2011/0285283 A1* 11/2011 Heid ..... H05H 5/02 315/5
2014/0265939 A1* 9/2014 Hettler ..... H05H 7/02 315/505

OTHER PUBLICATIONS

Reisman, D. B. et al., "Magnetically Driven Isentropic Compression Experiments on the Z Accelerator", Journal of Applied Physics, 2001, pp. 1625-1633, vol. 89.

(Continued)

*Primary Examiner* — Joseph Chang
(74) *Attorney, Agent, or Firm* — Kevin W. Bieg

(57) ABSTRACT

A variable-pulse-shape pulsed-power accelerator is driven by a large number of independent LC drive circuits. Each LC circuit drives one or more coaxial transmission lines that deliver the circuit's output power to several water-insulated radial transmission lines that are connected in parallel at small radius by a water-insulated post-hole convolute. The accelerator can be impedance matched throughout. The coaxial transmission lines are sufficiently long to transit-time isolate the LC drive circuits from the water-insulated transmission lines, which allows each LC drive circuit to be operated without being affected by the other circuits. This enables the creation of any power pulse that can be mathematically described as a time-shifted linear combination of the pulses of the individual LC drive circuits. Therefore, the output power of the convolute can provide a variable pulse shape to a load that can be used for magnetically driven, quasi-isentropic compression experiments and other applications.

16 Claims, 22 Drawing Sheets

Related U.S. Application Data

(60) Provisional application No. 61/862,170, filed on Aug. 5, 2013.

(58) Field of Classification Search
USPC ..... 307/108
See application file for complete search history.

(56) References Cited

OTHER PUBLICATIONS

Hall, C. A. et al., "Experimental Configuration for Isentropic Compression of Solids Using Pulsed Magnetic Loading", Review of Scientific Instruments, 2001, pp. 3587-3595. vol. 72.

Kudson, Marcus D. "Megaamps, Megagauss, and Megabars; Using the Sandia Z Machine to Perform Extreme Material Dynamics Experiments", Shock Compression of Condensed Matter, 2011 AIP Conference Proceedings 1426, 2012, pp. 35-42.

Davis, J.-P. et al., "Magnetically Driven Isentropic Compression to Multimegabar Pressures Using Shaped Current Pulses on the Z Accelerator", Physics of Plasmas, 2005, pp. 056310-1-056310-7, vol. 12.

Davis, J.-P. et al., "Analysis of Shockless Dynamic Compression Data on Solids to Multi-Megabar Pressures: Applications to Tantalum", Journal of Applied Physics, 2014, pp. 204903-1-204903-17, vol. 116.

Ao, T. et al., "A Compact Strip-Line Pulsed Power Generator for Isentropic Compression Experiments", Review of Scientific Instruments, 2008, pp. 013903-1-013903-16, vol. 79.

Woodworth, J. R. et al., "Low-Inductance Gas Switches for Linear Transformer Drivers", Physical Review Special Topics—Accelerators and Beams, 2009, pp. 060401-1-060401-17, vol. 12.

Madrid, E.A. et al., "Steady-State Modeling of Current Loss in a Post-Hole Convolute Driven by High Power Magnetically Insulated Transmission Lines", Physical Review Special Topics—Accelerators and Beams, 2013, pp. 120401-1-120401-16, vol. 16.

Stygar, W. A. et al., "Water-Dielectric-Breakdown Relation for the Design of Large-Area Multimegavolt Pulsed-Power Systems", Physical Review Special Topics—Accelerators and Beams, 2006, pp. 070401-1-070401-9, vol. 9.

* cited by examiner

VARIABLE-PULSE-SHAPE PULSED-POWER ACCELERATOR

CROSS-REFERENCE TO RELATED APPLICATIONS

This application is a continuation-in-part of application Ser. No. 14/451,209, filed Aug. 4, 2014, which claims the benefit of U.S. Provisional Application No. 61/862,170, filed Aug. 5, 2013, both of which are incorporated herein by reference.

STATEMENT OF GOVERNMENT INTEREST

This invention was made with Government support under contract no. DE-AC04-94AL85000 awarded by the U. S. Department of Energy to Sandia Corporation. The Government has certain rights in the invention.

FIELD OF THE INVENTION

The present invention relates to pulsed-power technology and, in particular, to a variable-pulse-shape pulsed-power accelerator that can be used to drive megabar-class material physics experiments and for other applications.

BACKGROUND OF THE INVENTION

Shock wave techniques have been used extensively to collect information on the high-pressure equation-of-state (EOS) of materials. However, most high-pressure EOS data have been obtained from shock compression which represents the response of a material along its principal Hugoniot. The need for accurate off-Hugoniot measurements has compelled the development of several experimental approaches to produce well-controlled continuous or ramp loading of condensed matter. Ramp loading of all materials and solids, in particular, generally produces thermodynamic states close to an isentrope since irreversible effects produced by visco-plastic and plastic work are usually small. This technique is often referred to as an isentropic compression experiment (ICE).

To generate a magnetic pressure of 100 gigapascals (GPa) on the surface of a conductor requires a 500 T magnetic field. Such a field is generated by a linear current density (on the conductor's surface) of 400 MA/m. The use of such current densities to generate magnetic pressures to drive material-physics experiments is described in the literature. See D. B. Reisman et al., *J. Appl. Phys.* 89, 1625 (2001); C. A. Hall et al., *Rev. Sci. Instrum.* 72, 3587 (2001); and M. D. Knudson, *Shock Compression of Condensed Matter*—2011, AIP Conf. Proc. 1426, 35 (2012). The technique has been used over the past 15 years for a variety of material studies. Currently, the refurbished Z accelerator (also referred to as ZR) produces tailored current pulses to drive samples quasi-isentropically to pressures as high as 500 GPa over timescales as long as 1 microsecond. See J.-P. Davis et al., *Physics of Plasmas* 12, 056310 (2005); and J.-P. Davis et al., *J. of Appl. Phys.* 116, 204903 (2014). In this technique, planar load samples (6-10 mm in diameter by 0.5-1.5 mm thick) are mounted on a flat anode plate of either aluminum or copper. A direct short between the parallel anode and cathode plates allows a ~20 MA, ~100-300 ns risetime current pulse to flow from one plate to the other, which generates a planar time-varying magnetic field between the conductors. The resulting large magnetic pressure launches a high-pressure ramp wave into the anode conductor and hence into the planar sample. A smooth, shockless compression is achieved with comparatively low compression strain rates of about $10^6$/s.

However, because the ZR accelerator is a large experimental facility designed to accommodate multiple scientific program needs, research for ICE studies is hampered by limited available machine time, considerable operational constraints, and expense. Further, although the pulsed-power technique has proven to be quite productive at large scale, several key issues must be examined thoroughly to extend the ICE method to different pulsed-power driver configurations. To expand the use of pulsed-power techniques for ICE studies, a compact pulsed-power generator, referred to as Veloce, was developed specifically for isentropic and shock compression experiments. See T. Ao et al., *Rev. Sci. Instrum.* 79, 013903 (2008), which is incorporated herein by reference. Veloce is a low inductance generator based on a stripline design where no oil, water, or vacuum is used for insulation, thus making it much easier to operate and maintain. The generator occupies a 3.6×5.5 $m^2$ area and delivers up to 3 MA of current rapidly over ~440-530 ns into an inductive stripline load where significant magnetic pressures can be produced. The magnetic pressure on Veloce can be used either to drive ramp pressure waves (5-20 GPa) into material samples or to launch relatively thick flyer plates (1-2 mm) to velocities of 1-3 km/s. However, the generator can only produce sub-megabar pressures. For most materials, the Hugoniot and isentrope diverge near a megabar, which is a pressure regime useful for equation-of-state studies. Further, because the Veloce generator uses a parallel plate transmission line, it has limited pulse shaping capability and, therefore, limited pressure ramping flexibility.

Therefore, a need remains for an accelerator that can produce variable pulse shapes with shorter rise times in order to maximize ramp wave propagation distances before shock formation occurs, thereby enabling the study of larger samples.

SUMMARY OF THE INVENTION

The present invention is directed to a novel variable-pulse-shape pulsed-power accelerator. The accelerator is driven by a plurality of independent LC circuits. Each LC circuit can comprise multiple capacitor-driven "brick" switches that deliver current to a power flow structure via impedance matched, transit-time-isolated coaxial cables. The coaxial cables deliver the circuit's output power to several water-insulated radial transmission lines that are connected in parallel at small radius by a water-insulated post-hole convolute. The output power of the convolute is delivered to a load that can comprise a megabar-class material physics or ICE experiment. The coaxial cables are sufficiently long to transit-time isolate the LC circuits from the water-insulated transmission lines, which allows each LC circuit to be operated without being affected by the other circuits. This enables the creation of any power pulse that can be mathematically described as a time-shifted linear combination of the pulses of the individual LC circuits.

As an example of the invention, described herein is a pulsed-power accelerator that delivers a precisely shaped current pulse with a peak value as high as 7 MA to a stripline load. The peak magnetic pressure achieved within a 1-cm-wide load is can be in excess of 100 GPa. The exemplary accelerator is powered by as many as 288, decoupled and transit-time-isolated bricks. Each brick consists of a single switch and two capacitors connected electrically in series. The bricks can be individually triggered to achieve a high degree of current-pulse tailoring. Because the accelerator is impedance matched throughout, capacitor energy is delivered to the stripline load with an efficiency as high as 50%. Iterative finite-element-method (FEM), circuit, and magnetohydrodynamic simulations were used to develop an optimized accelerator design. The number of bricks will depend on the current, pressure and pulse shape desired. When powered by 96 bricks, the accelerator delivers as much as 4.1 MA to a load, and achieves peak magnetic pressures as high as 65 GPa. When powered by 288 bricks, the accelerator delivers as much as 6.9 MA to a load, and achieves magnetic pressures as high as 170 GPa. An algebraic calculational procedure was developed that uses the single-brick basis function to determine the brick-triggering sequence necessary to generate a highly tailored current-pulse time history for shockless loading of samples. The accelerator will drive a wide variety of magnetically driven shockless-ramp-compression, shockless-flyer-plate, shock-ramp, equation-of-state, material-strength, phase-transition, and other advanced material-physics experiments.

BRIEF DESCRIPTION OF THE DRAWINGS

The detailed description will refer to the following drawings, wherein like elements are referred to by like numbers.

FIG. 2(*b*) is a schematic illustration of a brick tower consisting of eight bricks stacked vertically, each brick having four cable outputs.

FIG. 4(*b*) is a schematic cutaway view of an ICE panel in the center load region. FIG. 4(*c*) is a schematic side-view illustration of the double post-hole convolute (DPHC) and water-Rexolite transition sections.

FIG. 8(*b*) shows the electric fields at the Rexolite-Kapton interface.

FIG. 9(*a*) is a cutaway top-view of the field in AK gap from outer convolute to load. FIG. 9(*b*) shows the concentration of fields in the stripline load.

FIG. 11(*b*) is a contour plot of the electric field.

FIG. 13(*b*) is a contour plot of density in ICE panel at 300 ns (peak pressure). Lines are magnetic flux.

DETAILED DESCRIPTION OF THE INVENTION

The present invention is directed to a variable-pulse-shape pulsed-power accelerator that can achieve pressures in excess of 100 GPa. At such pressures, the Hugoniot and isentrope for most materials diverge; hence 100-GPa-class experiments are extremely interesting and useful for equation-of-state studies. The accelerator also provides a precise pulse-tailoring capability which enables a wide variety of shockless material-physics experiments. In particular, the accelerator can be used to explore equation-of-state, material strength, and phase transition properties for a wide variety of materials. The accelerator overcomes the shortcomings of current compact machines, yet realizes the benefits of an inexpensive ICE driver with a high shot rate capability.

Exemplary Accelerator Configuration

Figure 1:
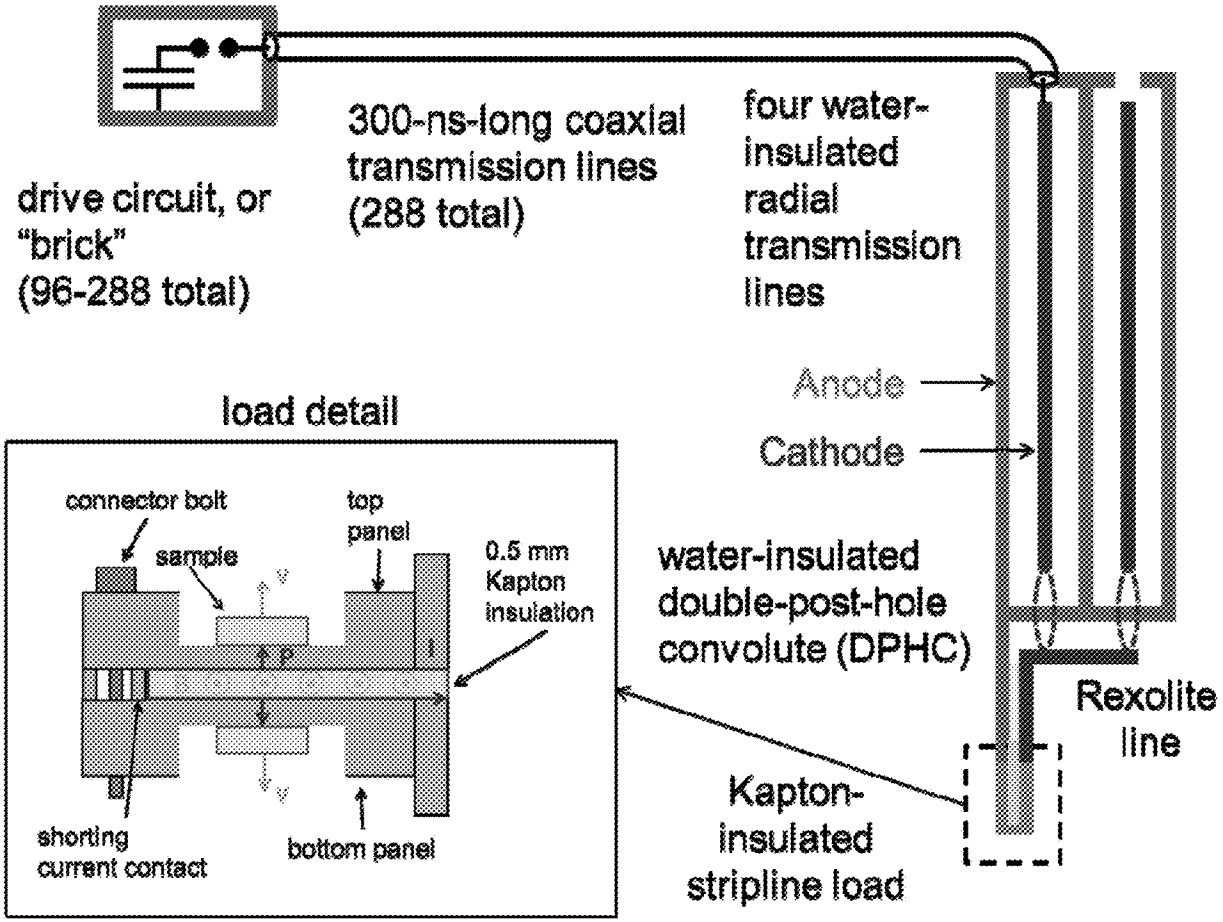
FIG. 1 is a schematic illustration of a single pulse-forming circuit of a variable-pulse-shape pulsed-power accelerator. Also shown in the inset is a cross-sectional ICE load detail depicting the magnetic pressure exerted on the panels and samples.

In FIG. 1 is shown a schematic illustration of a single pulse-forming circuit of a variable-pulse-shape pulsed-power accelerator. The pulse-forming circuit begins with a low-inductance LC drive circuit, or "brick." The accelerator comprises a large plurality of such independent pulse-forming circuits that can be combined to form a single power pulse with a variable pulse shape. The brick can be coupled to one or more high-voltage coaxial transmission lines. The long coaxial transmission lines decouple the plurality of switched bricks from each other. Therefore, the coaxial transmission lines can create independent drive pulses. This transit-time isolation of the bricks provides unprecedented flexibility in pulse shaping. The coaxial transmission lines can be impedance matched to minimize reflections in the system and maximize power delivered to a load. The coaxial transmission lines deliver the output power of each brick to multiple water-insulated radial transmission lines. The radial transmission lines can be connected in parallel at small radius, for example by a water-insulated multiple post-hole convolute. The output power of the convolute can be delivered to a shorted load, such as shown in the inset, to enable a megabar-class material physics or ICE experiment.

Below is described an exemplary variable-pulse-shape pulsed-power accelerator. The exemplary accelerator comprises: (1) 96-288 "bricks" which can be individually triggered. (2) 288 coaxial cables which are impedance matched to the bricks. The cable transit-time length is chosen to be 300 ns in order to avoid wave reflections. (3) A central, water-dielectric tri-plate transmission line which is joined into a single line through a double post-hole convolute (DPHC). (4) A solid-dielectric (e.g., Rexolite®) transmission line. (5) A solid-dielectric (e.g., Kapton®) insulated stripline load.

Figure 2A:
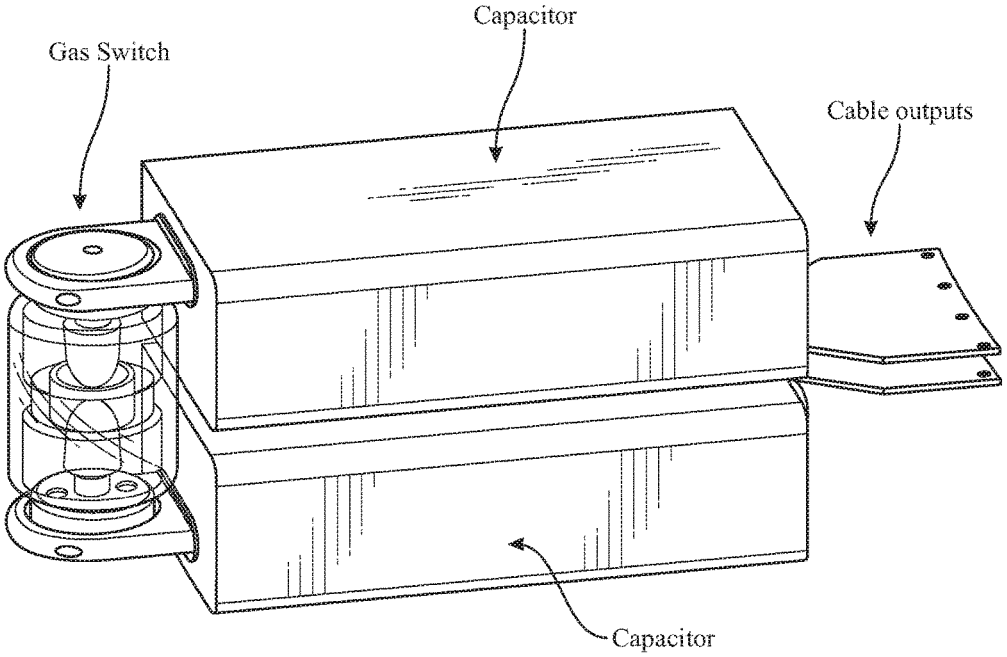
FIG. 2(*a*) is a schematic illustration of an individual brick consisting of two capacitors connected to a gas switch.
Figure 2B:
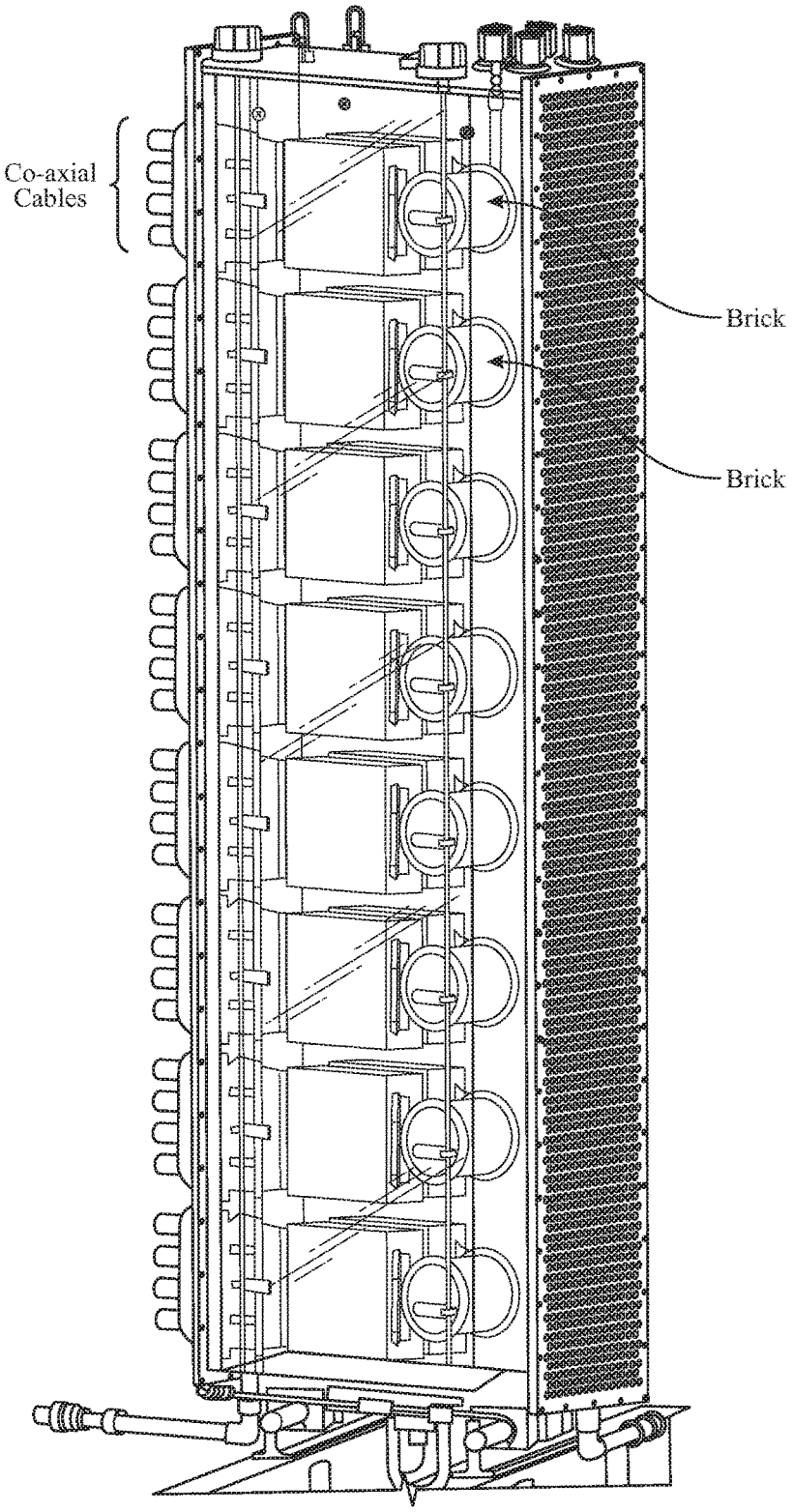

As shown in FIG. 2(*a*), each brick consists of two capacitors, a triggered switch, and cable outputs. The two capacitors are charged to opposite polarities with a triggered gas breakdown switch between their high voltage outputs. To achieve a short current rise time, the inductance of the gas switch and capacitors is preferably minimized. For example, the two brick capacitors can each have a capacitance of 80 nF and can be charged up to a maximum of +/−100 kV. The brick switch can be a high-voltage, low-inductance field distortion switch. See J. R. Woodworth et al., *Phys. Rev. ST Accel. Beams* 12, 060401 (2007); and U.S. application Ser. No. 14/099,524. The switch is triggered electrically from an electric trigger generator that provides a 100-kV pulse of rise time of 10-20 ns. Each brick has an inductance of approximately 240 nH and a resistance of 0.37Ω. The individual brick energy is 800 J with a resonant frequency of 2 MHz. Multiple bricks can be stacked in parallel in a brick tower. FIG. 2(*b*) is a schematic illustration of a "brick tower" consisting of eight vertically stacked bricks, each brick having four cable outputs. As will be described below, the brick tower can feed a cable run section, comprising a plurality of transit-time isolated coaxial cables (coaxial transmission lines), which in turn feeds the central power flow and load sections.

Each brick is approximately impedance matched to the output coaxial cables, which act as constant impedance transmission lines to the central power flow section. The optimal impedance is given by the formula $$Z = 1.1\sqrt{\frac{L}{C}} + 0.8R. \tag{1}$$

Figure 3:
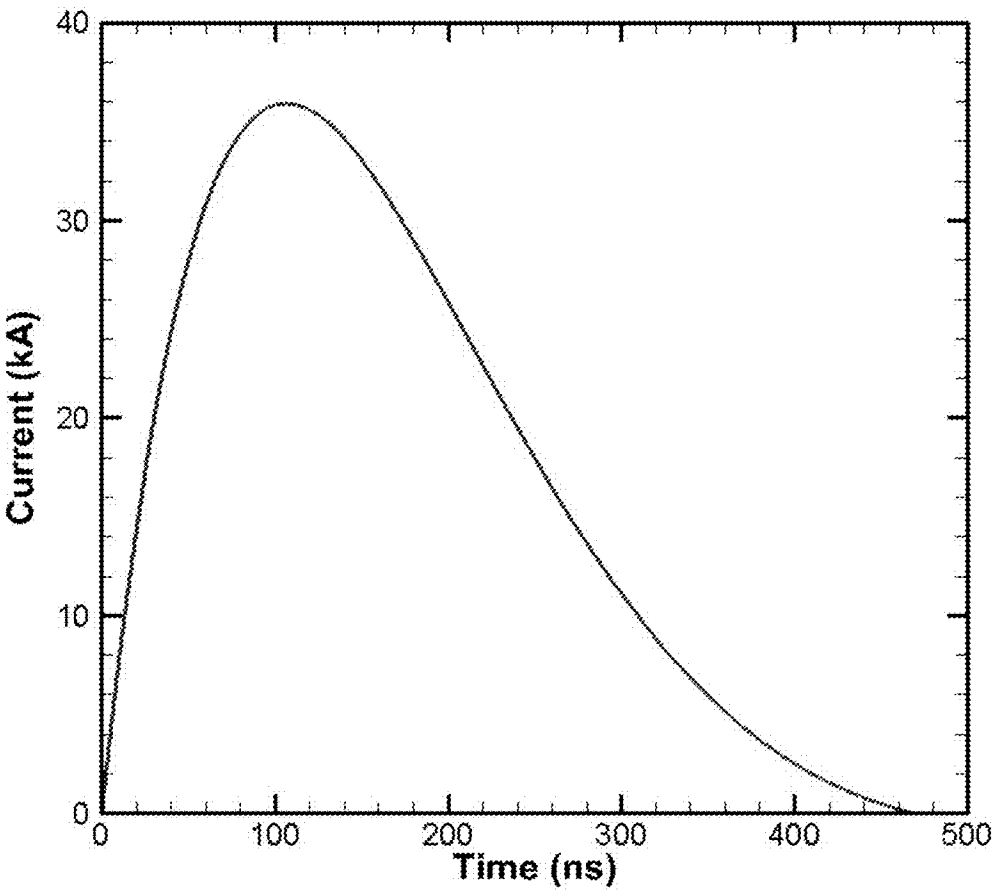
FIG. 3 is a graph of the current versus time for a single brick into three 10-Ω cables. The equivalent total cable impedance is 3.3Ω and brick impedance is 3Ω. The initial capacitor charge is +/−100 kV.

In this example, Z=3.0Ω. Eight brick boxes are arranged into brick towers which are sealed and filled with dielectric insulating oil. For the 96-brick accelerator, three ~10-Ω coaxial cables connected in parallel to each brick box approximately match the impedance of the brick. Alternatively, four cable outputs per brick can be used if the switches and capacitors are less inductive and consequently produce lower brick impedance. A graph of the current for a single brick is shown in FIG. 3. Peak current for a +/−100 kV capacitor charge is 36 kA with a risetime of ~60 ns.

Each of the exemplary coaxial cables can comprise an inner and outer braid of copper conductors, a polyethylene insulator between the conductors, and a thin semiconducting layer on the negative-polarity inner braid. The inner and outer conductors of the coaxial cable can be at radii 1.27 cm and 1.63 cm, respectively. The overall diameter of the coaxial cable is 3.81 cm, including the outer plastic shield. Each cable can be 60-m long to obtain the 300-ns transit time required to isolate each brick. The transit time is given by $\tau = l/c$ where l is the cable length and the propagation speed is given by $c = 1/\sqrt{\mu\varepsilon}$. The cable impedance was initially estimated to be approximately 10Ω. An accurate determination of cable parameters can be made with vector network analyzer (VNA) techniques. The coaxial cables can be flexible to enable a vertical wall of brick towers to be positioned remotely from a circular central-power-flow (CPF) section.

Figures 4A, 4B, 4C:
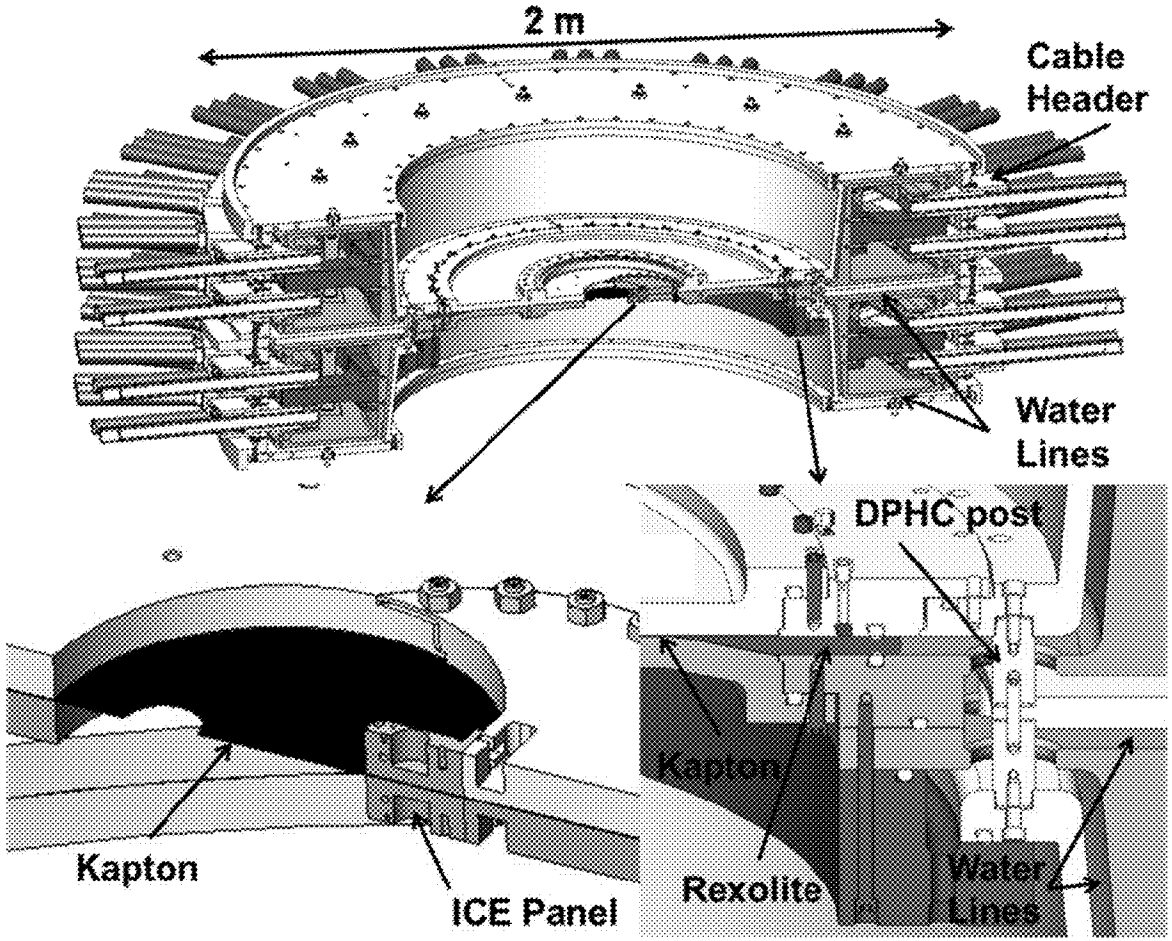
FIG. 4(*a*) is a schematic cutaway view of the central-power-flow (CPF) section of a variable-pulse-shape pulsed-power accelerator.
Figure 5:
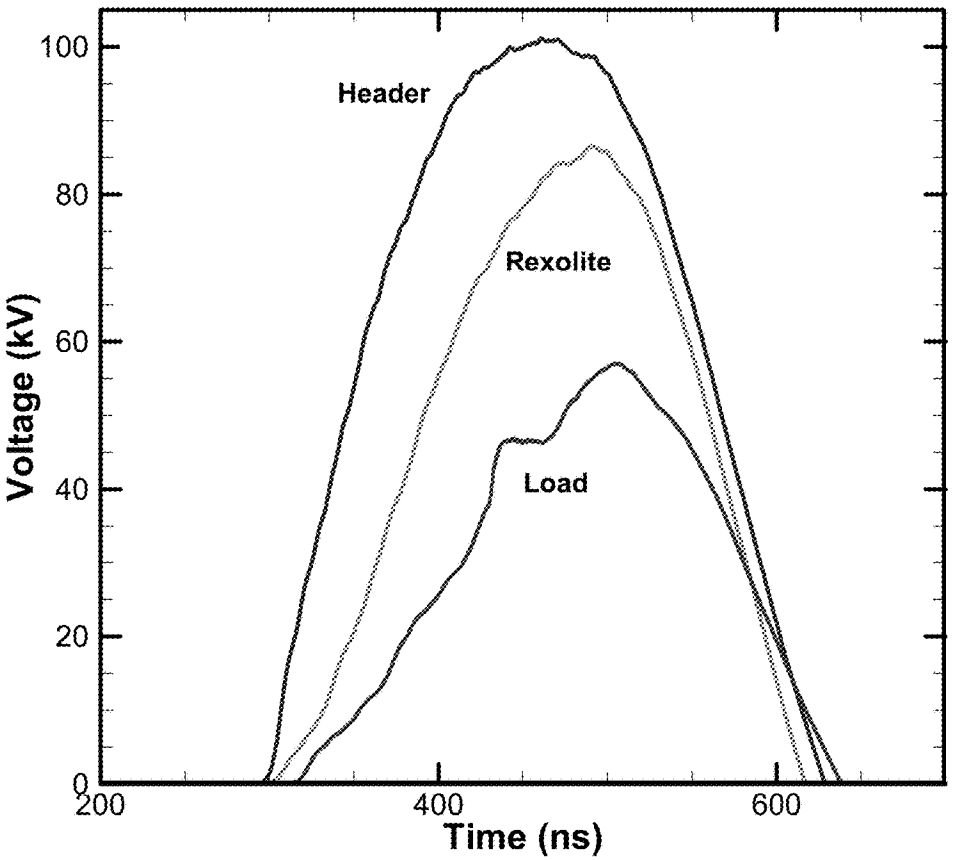
FIG. 5 is a graph of voltage waveforms for various regions of the CPF section.

As shown in FIG. 4(*a*), the 288 cables from the 96 bricks are connected to a 2-meter diameter CPF section comprising four water-insulated radial transmission lines with an AK gap of 1 cm. The current from these four parallel radial transmission lines is connected at small radius into a single line using a water-insulated 40-post DPHC structure, as shown in FIG. 4(*c*). The DPHC joins the inner radii of the four radial transmission lines by cutting a hole in the cathode conductors and joining the outer and middle anode electrodes of the transmission lines with a through-anode post. In the absence of any losses, the individual transmission line currents add in linear combination to drive the load. See E. A. Madrid et al., *Phys. Rev. Special Topics—Accelerators and Beams* 16, 120401 (2013), which is incorporated herein by reference. The output power of the convolute is delivered to a single solid-dielectric radial transmission line. The single solid-dielectric radial transmission line downstream from the water convolute can use an insulator having a high dielectric strength, such as Rexolite (Rexolite® is a registered trademark of C-LEC Plastics, Inc.), a crosslinked polystyrene having a dielectric strength of about 819 kV/cm and low water absorption. Therefore, the remaining line can be insulated with a layer of Rexolite which varies in AK gap length of 1 cm at large radius down to a gap of 0.1 cm at the load. As shown in FIG. 4(*b*), this radial Rexolite line can then transition to a 0.05-cm-thick Kapton-insulated stripline within the central load section.

A cross-sectional illustration of a single set of stripline load panels that are connected to each other by a direct short is shown in the inset in FIG. 1. Typical stripline load panels are 1.0 cm to 2.0 cm in width with a length approximately equal to twice the width. See T. Ao et al., *Rev. Sci. Instrum.* 79, 013903 (2008), which is incorporated herein by reference. This factor-of-two aspect ratio ensures uniform pressure drive over the sample region. Panels with widths as narrow as 0.5 cm have been fielded on stripline generators, but special care must be taken to manage pressure-driven edge waves that can interfere with sample measurement. Load panels can be made of either oxygen-free high conductivity (OFHC) copper or aluminum alloy and can be separated by a Kapton®-layered film package of total width of 0.5 mm. Therefore, the two load panels (designated as "top" and "bottom" in the inset) can be insulated by sheets of thin Kapton HN polyimide film (Kapton® is a registered trademark of DuPont). This material has a minimum dielectric strength of about 236 kV/mm. The insulating Kapton constrains the current flow/between the top and bottom panels to be along the inner surfaces between them by means of a shorting current contact. The pulse generates a time-varying magnetic field in the anode-cathode gap of the short circuit. The subsequent Lorentz force generated by the high current and magnetic field produces magnetic compression of the cathode and anode over the pulse time of the accelerator. Therefore, within the gap between the panels, strong magnetic fields B are set up perpendicular to the current path, and the resulting J×B force produces a large magnetic pressure on the panels. The pressure on the panels varies proportionately to the square of the current divided by the panel width. Although narrow panels can generate higher pressures, the narrowness of the panel width is limited by lateral release waves that emanate from the panel edge that can affect the spatial uniformity of the longitudinal pressure wave profile into the sample. Therefore, a larger panel is desirable for more uniform loading of the sample. The magnetic pressure at the inner panel surface initiates a hydrodynamic wave P that propagates through the load panels and reaches the outer panel surface where material samples are placed.

Other short-circuit load geometries can also be used, depending on the material physics experimental of interest. See M. D. Knudson, *Shock Compression of Condensed Matter*—2011, *AIP Conf. Proc.* 1426, 35 (2012), which is incorporated herein by reference. The stripline geometry described above has typically been used for ramp compression experiments. Alternatively, the load can comprise a coaxial geometry comprising four anode panels surrounding a rectangular cathode stalk. The coaxial geometry has typically been used for high-pressure shock compression experiments.

Simulation of a 96-Brick Accelerator

Iterative FEM, circuit, and MHD simulations were used to determine an exemplary 96-brick accelerator design. Initially, estimates of circuit elements were determined using analytic formulas for impedance and inductance. For instance, the impedance (Z) and inductance (L) of the axisymmetrical geometry of the CPF section are given by $$Z = \sqrt{\frac{\mu_0}{\varepsilon_0 \varepsilon_R}} \frac{g}{2\pi r} \text{ and} \tag{2}$$

$$L = 2g\ln\left(\frac{r}{r_0}\right) \tag{3}$$

where r is the radius, $r_0$ is the inner radius, and g is the electrode gap. Later, these estimates were improved using FEM calculations. Circuit calculations were then performed to determine baseline performance and voltage thresholds for FEM field calculations. Finally, MHD calculations were performed to obtain the dynamic load inductance, a large effect in these systems. With this complete set of circuit parameters and voltage conditions, load performance can be calculated along with the electric field breakdown thresholds of the CPF section. The final results of this design process are described below.

A 96-brick arrangement driving the aforementioned CPF section was assumed with a stripline load consisting of 1-cm-wide by 2-cm-long copper panels. The electrical characteristics of the accelerator were modeled with the SCREAMER circuit code. See M. L. Kiefer and M. M. Widner, in *Proceedings of the 5th IEEE International Pulsed Power Conference,* edited by M. F. Rose and P. J. Turchi (IEEE, Piscataway, N.J., 1985), p. 685; and M. L. Kiefer et al., SCREAMER, a pulsed power design tool, user's guide for version 3.2.4.2 (2008). Each part of the accelerator circuit is included in the model as either an LRC element or a transmission line. Cable attenuation was included as a resistance based on VNA measurements of the coaxial cable. Code outputs are current, energy, power, and voltage for each model element. Brick LRC values are given by manufacturer specifications and laboratory tests for similar configurations.

Peak current is calculated to be 4.1 MA with 35 kJ of energy delivered to the static stripline load. In this calculation, four groups of 50 capacitors are triggered at staggered intervals to achieve a ~200-ns rise-time (defined over a 5-95% rise in current). All capacitors are initially charged to +/−100 kV. The peak voltage on the cables is 120 kV. Peak voltages in the waterline section and the Rexolite insulator are 100 and 85 kV, respectively. The load voltage which is applied across the stripline Kapton insulated gap is 60 kV.

The CPF section is modeled using the COMSOL Multiphysics® simulation code. See COMSOL Multiphysics® 5.0. The code uses the finite element method (FEM) to solve for the electric and/or magnetic fields in static, frequency dependent or transient mode. First, the static electric field mode was used to calculate the electric field distributions driven by the peak voltages calculated with the circuit code. Second, the frequency-dependent magnetic field solver was used to calculate the inductance of the convolute structure and the impedance of the cables. Lastly, the electric field distributions in the cable header region were calculated.

Figure 6:
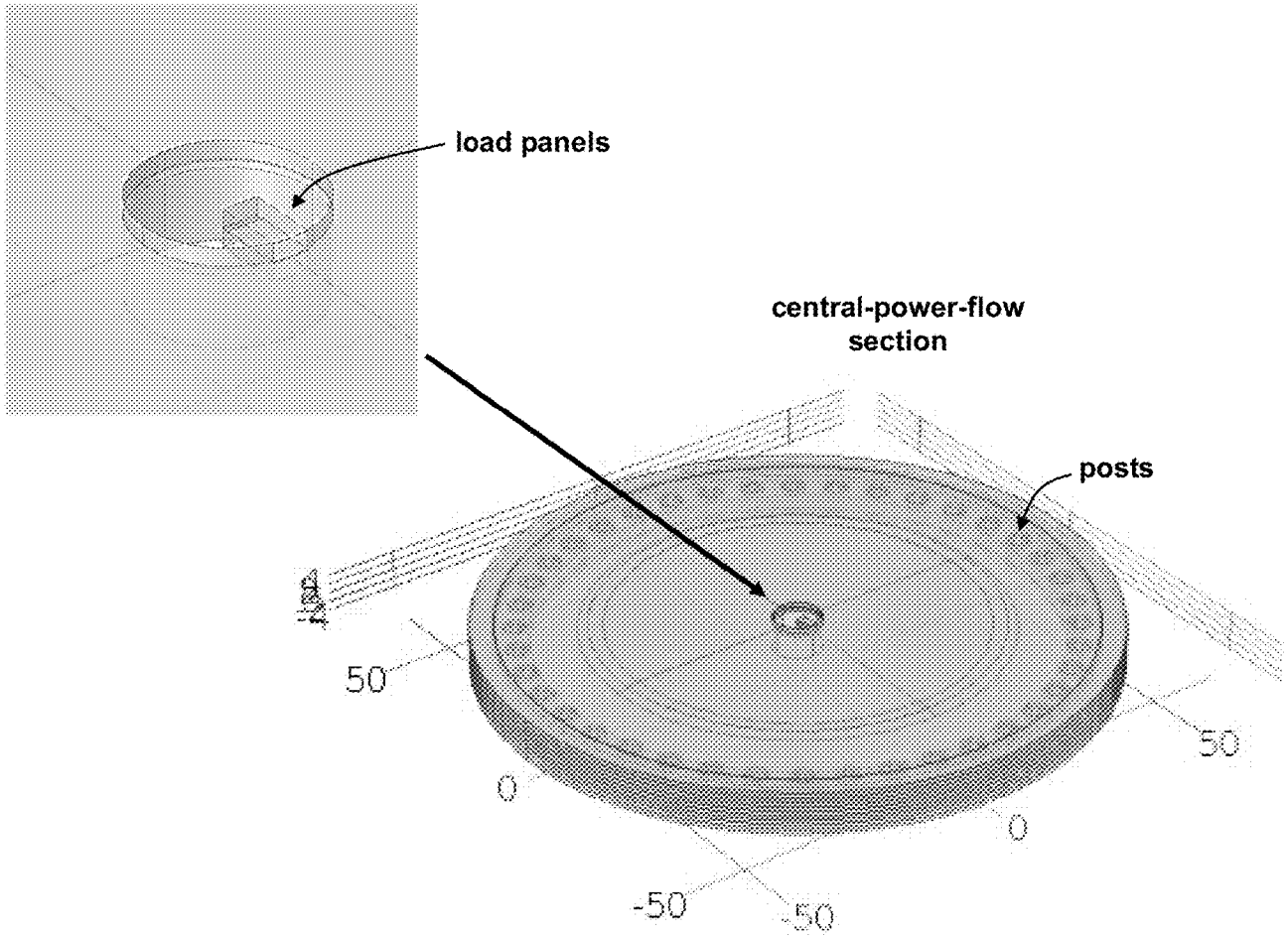
FIG. 6 shows a 3D COMSOL computational setup for calculation of CPF section+magnetic and electric fields.

Although the CPF section extends out to a diameter of 2 m, only the inner 1.4-m diameter of the structure, including the DPHC, was considered in the simulation, as shown in FIG. 6. All the important transitions occur within that radius and the inductance beyond that radius can be easily estimated with Eq. (3) or a separate calculation for the cable header-water line section. Using the water line peak voltages from the previous section, the electric field distributions were calculated. It is important to the design to maintain an electrical field strength that is below the known electrical field breakdown thresholds. Special attention must also be paid to the triple-point regions where fields can be enhanced due to disparities in dielectric constants across material boundaries.

The electric field strength thresholds were determined for the three insulator materials—water, Rexolite, and Kapton. For a water-insulated line this is given empirically by the formula $$E_P = 108\Sigma_{EFF}^{-0.33}(\text{kV/cm}) \tag{4}$$

where $E_P$ is the peak electrical field and $\tau_{EFF}$ is the temporal width (in μs) of the voltage pulse at 63% of peak. In the case of $\tau_{EFF}$=200 ns, $E_P$=184 kV/cm. See W. A. Stygar et al., *Phys. Rev. ST Accel. Beams* 9, 070401 (2006). The Rexolite breakdown threshold has been determined to be ~800 kV/cm while layered Kapton has a threshold of ~2000 kV/cm.

Figure 7:
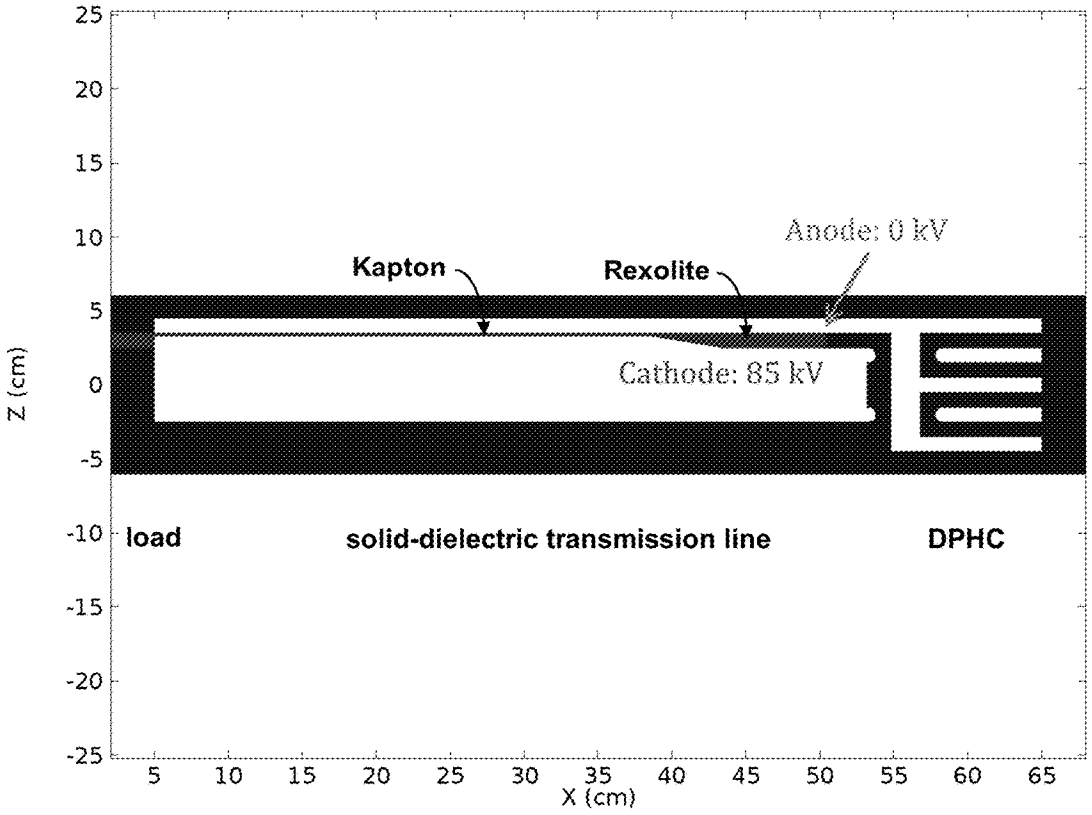
FIG. 7 is a cutaway side-view illustration of the DPHC structure used in the calculation of electric fields. Shown are the boundary voltage values used for the electric field calculations.
Figure 8A:
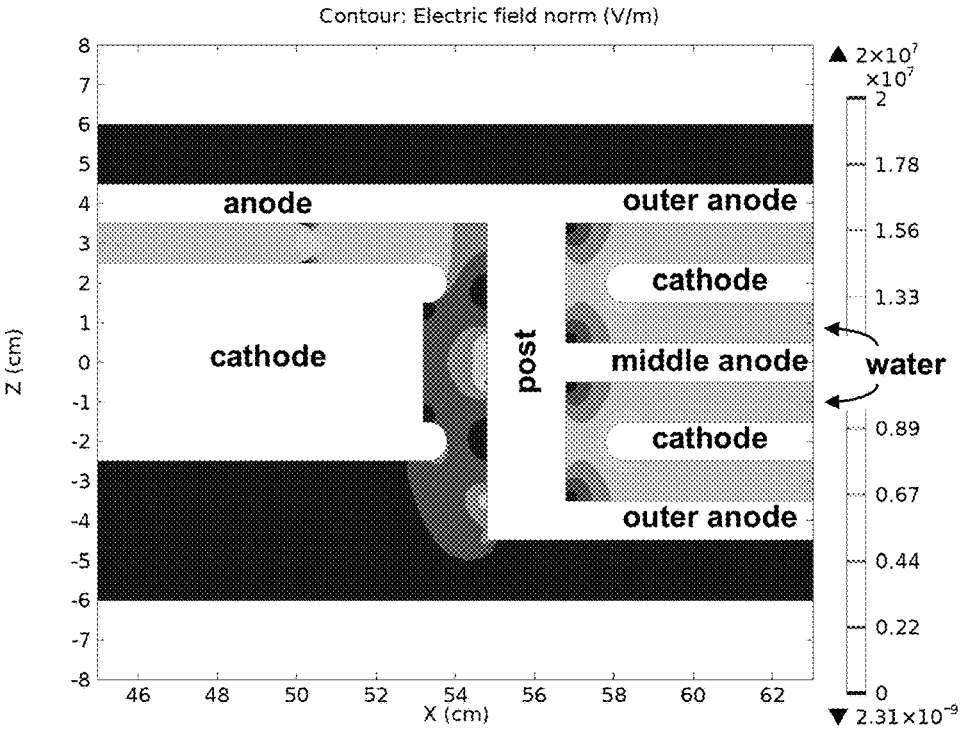
FIG. 8(*a*) is a close-up side-view illustration of the electric fields in the DPHC and water-Rexolite transition.
Figure 8B:
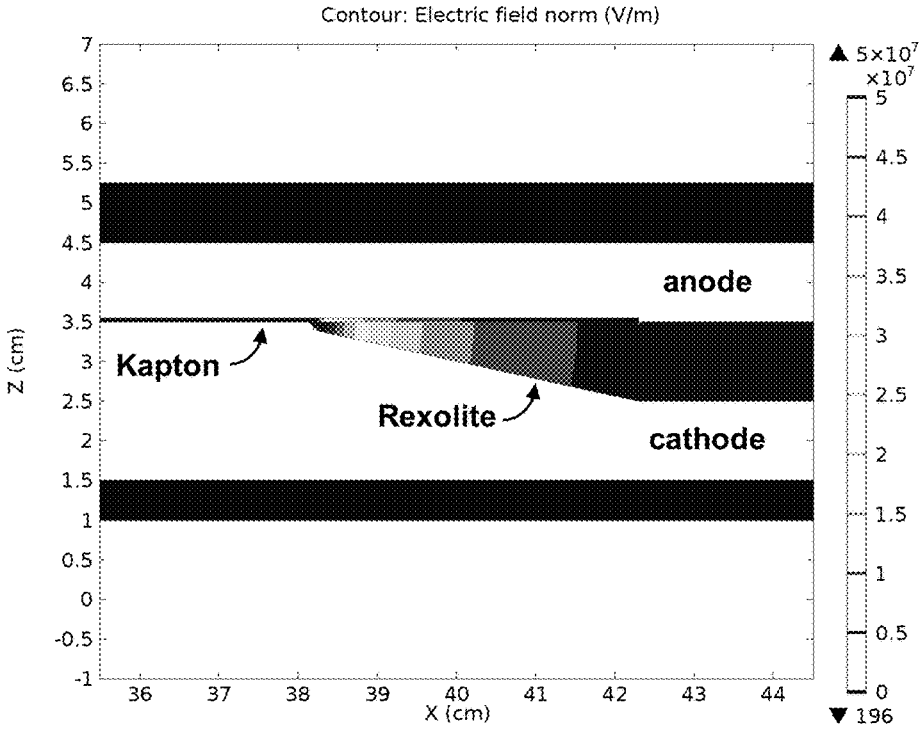

Assuming an 85-kV voltage across the AK gap as the boundary condition, the electric fields in the CPF section were calculated using the COMSOL code as shown in FIG. 7. Slice contour plots of electric field magnitude for the DPHC water region and the CPF insulator region are shown in FIGS. 8(*a*) and 8(*b*), respectively. Note that the Rexolite insulator is tapered from the water-line gap thickness (10 mm) to the final value (1 mm) in order maintain electric fields at the Rexolite-water interface that are below the water dielectric thresholds. In the water region, the maximum electric field is ~100 kV/cm, which is well below the water dielectric threshold of 184 kV/cm. In the insulator region, the field increases to ~500 kV/cm in the Rexolite before transitioning to the Kapton which is at ~1700 kV/cm. Both these values are below the Rexolite and Kapton breakdown thresholds.

Figure 9A:
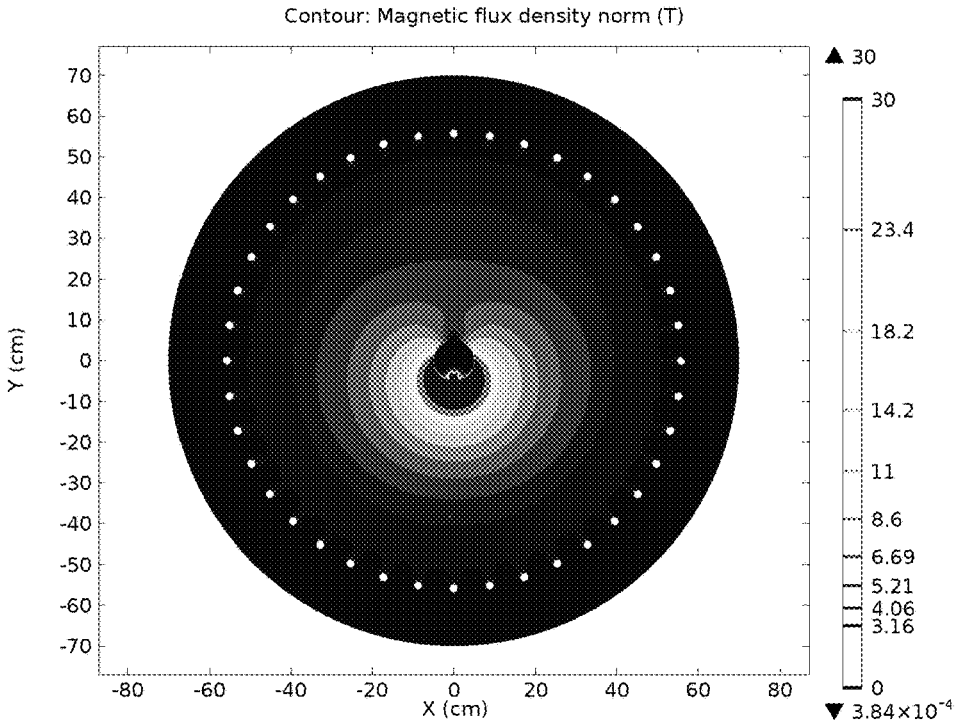
FIGS. 9(*a*) and 9(*b*) are top-view contour plots of the magnetic field in CFS.
Figure 9B:
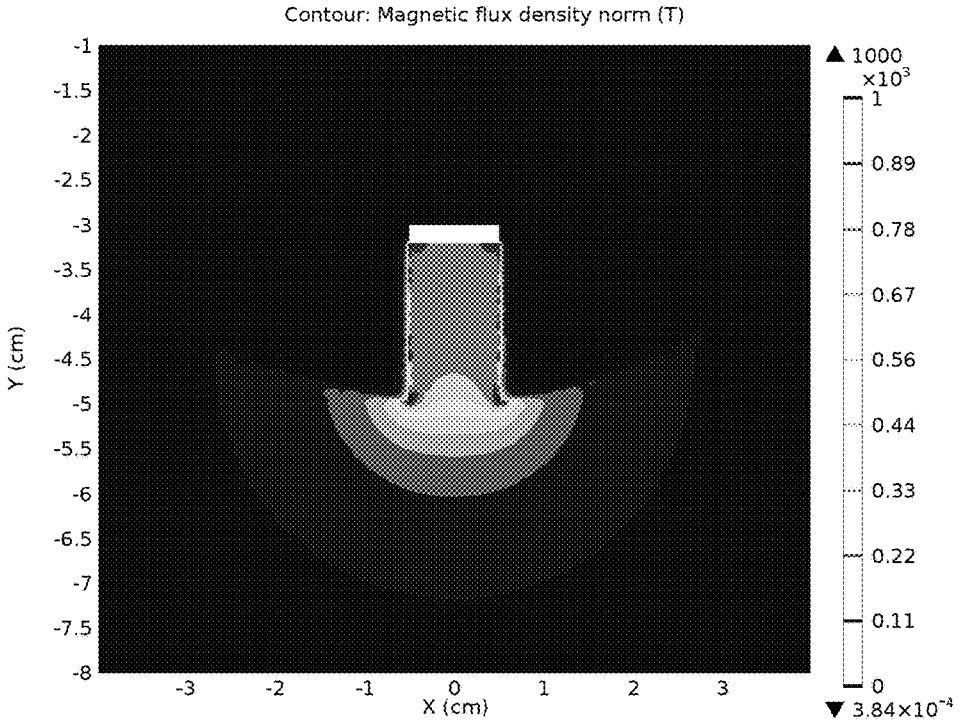

Having established sufficient gaps for operating the inner power-flow structure, the inductance of the system can be calculated. A frequency-dependent magnetic field calculation was used to capture skin-depth effects on the inductance. Assuming an input current of 8 MA at a frequency of 2 MHz, the magnetic field distribution in the CPF region was calculated. FIGS. 9(*a*) and 9(*b*) are top-view slice illustrations of the magnetic field magnitude showing concentrations of fields in the posts (outer light dots in FIG. 9(*a*)) and in the stripline load region (central rectangular section in FIG. 9(*b*)) where the entire field is concentrated. As shown in FIG. 9(*b*), a peak magnetic field of ~800 T is obtained in the 1-cm-wide stripline which corresponds to a magnetic pressure of 250 GPa. It should be noted that this calculation is static. In an actual experiment, the plates will separate due to the Lorentz force, increasing the gap and reducing the fields and pressures due to edge effects. Inductance of the structure is calculated through the energy relation $L=\sqrt{2E_M}/I$ where $E_M$ is the magnetic energy. For this particular stripline load arrangement the static inductance is found to be 2.5 nH. Including the remainder of the CPF structure a total inductance of 3.0 nH is obtained.

Figure 10:
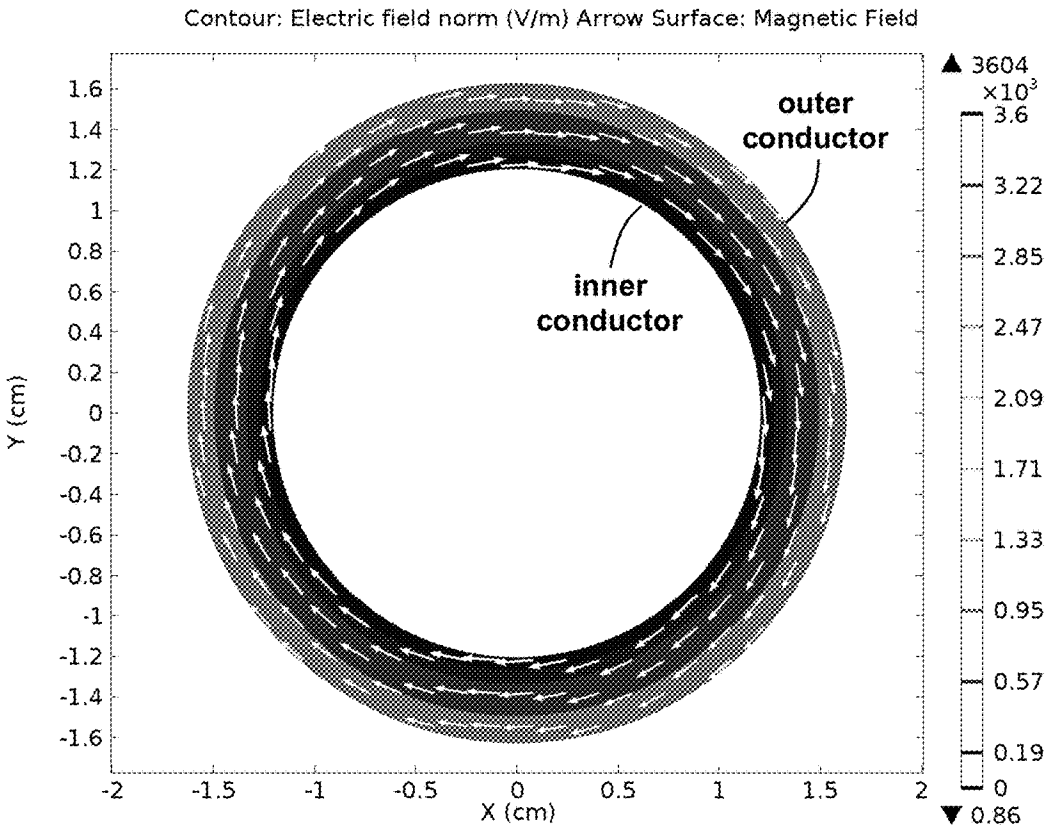
FIG. 10 shows an RF calculation of EM fields in a cross-section of a coaxial cable. White lines are magnetic field vectors. Contours are electric fields.

Coaxial cable impedance was modeled with the COMSOL simulation code. To determine impedance, the coax is modeled as a two-dimension cross-section of a TEM waveguide. First, the electric and magnetic field distributions at a frequency of 2 MHz are calculated, as shown in FIG. 10. As can be seen in the figure, the semiconducting layer pushes the electric field away from the inner conductor, a desired effect to prevent breakdown coronas on the cathode. Second, line integrals of electric and magnetic field are used to calculate voltage and current according to $$V = V_i - V_o = -\int_{R_o}^{R_i} E \cdot dr \text{ and} \tag{5}$$

$$I = \frac{1}{\mu_0}\oint_C B \cdot dl \tag{6}$$

where the subscripts i and o denote inner and outer conductor quantities. Finally, the characteristic impedance is calculated through the relation Z=V/I. The impedance of the cable is found to be 10.8Ω at a frequency of 2-MHz; VNA measurements later confirmed this value.

Figure 11A:
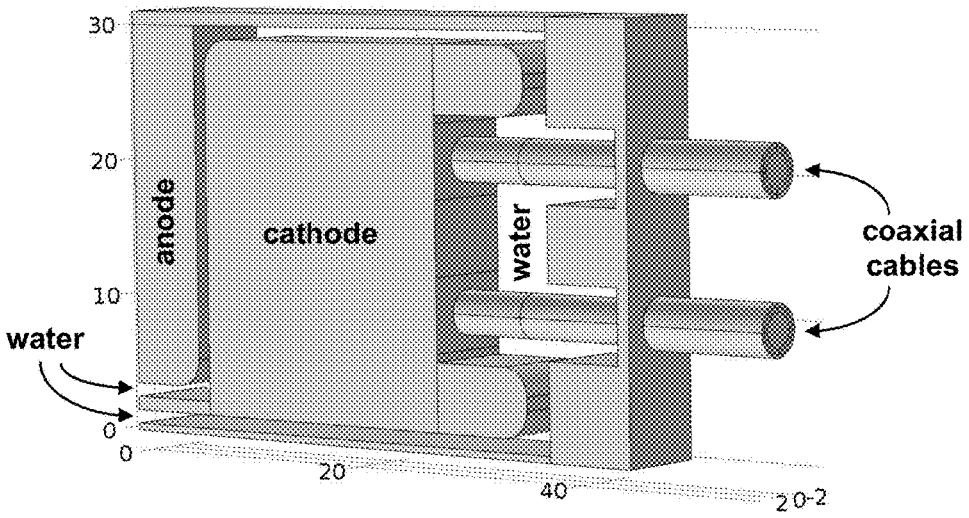
FIG. 11(*a*) shows a computational setup of a 3D field calculation in the cable header-water line region.
Figure 11B:
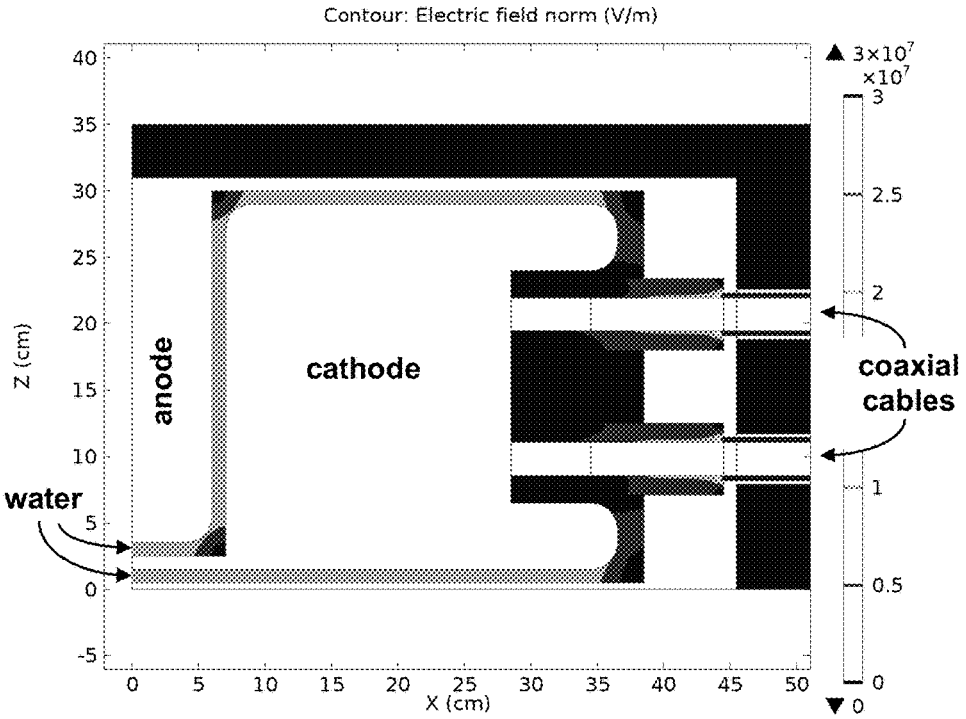

The cable connection region was modeled to determine if any electrical breakdown thresholds were exceeded. Because of the periodic nature of the cable connection region to the CPF section, only two cables were modeled on half of the CPF cable header region, as shown in FIG. 11(*a*). Mirror boundary conditions were imposed to accurately represent a section of the geometry. As in the modeling described earlier, a voltage of 100 kV was applied across the AK gap as a boundary condition. As seen in FIG. 11(*b*), contours of electric field show concentrations in the region of cable "break-out" where the center conductor of the coaxial cable enters the water dielectric. The field in the break-out region can be managed by introducing a Delrin plug that reduces the electrical field at the poly-water interface. By doing this the peak electric field can be reduced to be below the breakdown threshold of water.

Magnetohydrodynamic (MHD) calculations were performed to determine the full system electrical performance and peak pressures delivered to a stripline load. Because the inductance of the load at the time of peak pressure is significant relative to the total inductance, an accurate estimate of delivered current must include the dynamic inductance of the stripline. Trac-II, a resistive 2D MHD code, was used to model a cross section of the stripline. See D. B. Reisman et al., *J. Appl. Phys.* 89, 1625 (2001). The code can be used to calculate pressure drive on an ICE load and the dynamic inductance. 3D effects are assumed to be small and were neglected. The SCREAMER circuit code was used to obtain the load drive voltage which was applied as an input to the Trac-II simulations. Self-consistency was obtained by using the time dependent inductance from the MHD calculation in the circuit code to obtain an improved drive voltage. This process was repeated until agreement in voltage and current was obtained between SCREAMER and Trac-II.

Figure 12:
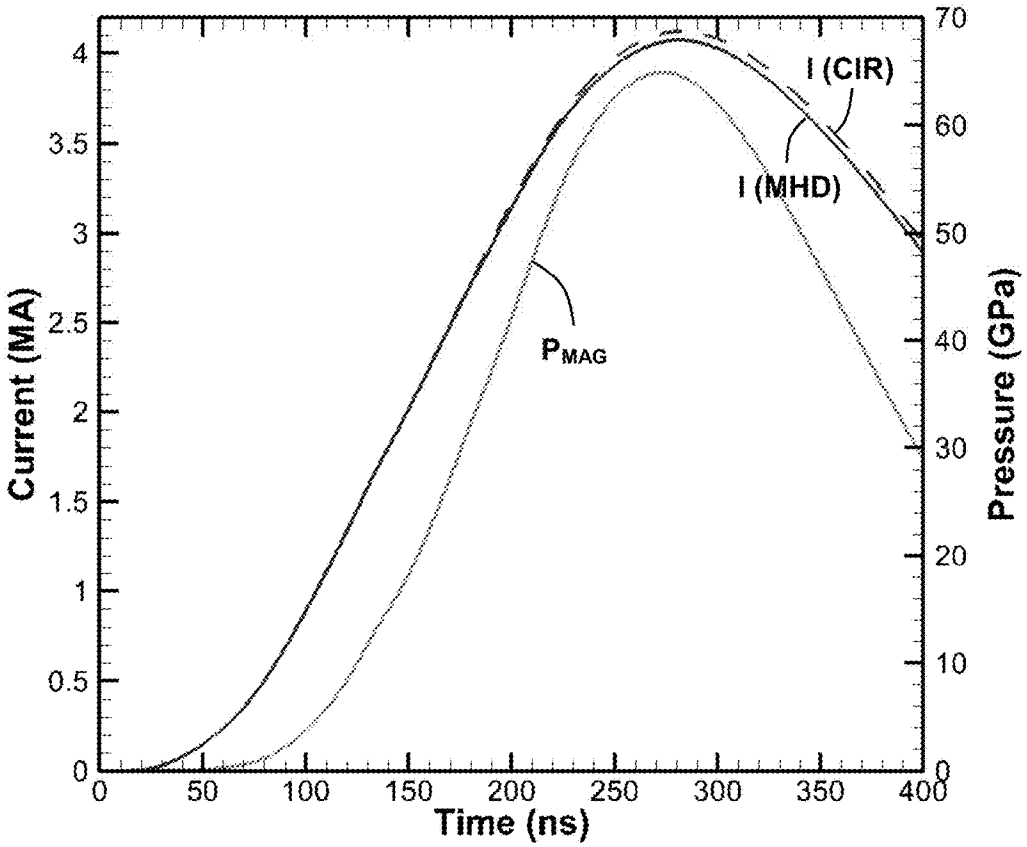
FIG. 12 is a graph of the current and magnetic pressure for the 96-brick accelerator. Current is computed in both Trac-II MHD code and in the SCREAMER circuit code.
Figure 13A:
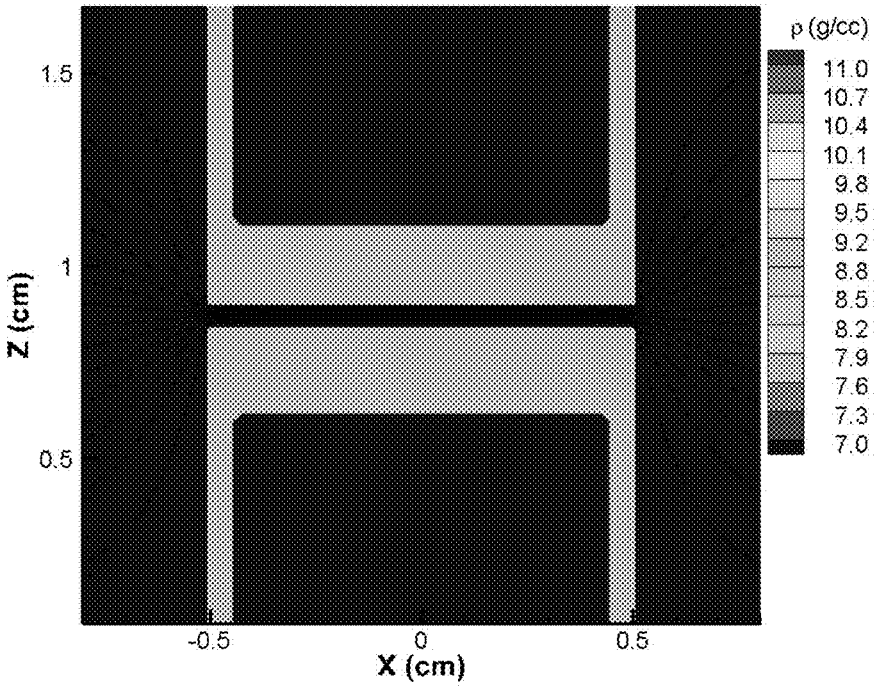
FIG. 13(*a*) is a contour plot of density in ICE panel at 0 ns (peak pressure).
Figure 13B:
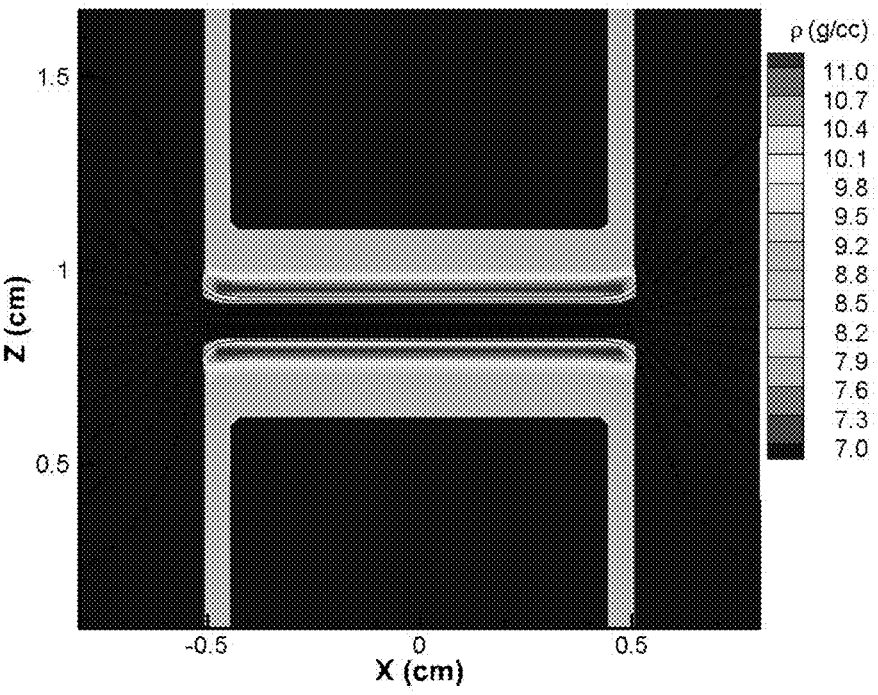

Pulse tailoring was obtained by triggering four groups of capacitors at staggered 50-ns intervals. For this particular case, a nearly linear 200-ns pulse with peak current of 4.1 MA produced a peak magnetic pressure of 65 GPa, as shown in FIG. 12. During the pulse the stripline load inductance increases from 1.2 nH to 2.3 nH as the panels are compressed and separate, as shown in FIGS. 13(*a*) and 13(*b*).

Extension to 144 and 288-Brick Accelerators

Several options exist for extending the exemplary design to well beyond 96 bricks and increasing the peak current and pressure at the ICE load. One of these is to simply increase the diameter of the CPF section to allow more of the 10.8-Ω cables to be connected and therefore more bricks to be added to the system. A more challenging, but more attractive option is to lower the impedance of the individual cables and allow more cable connections while maintaining the impedance matching conditions between brick and cable. For instance, a 3.0-Ω cable would allow one cable per brick and result in up to 288 bricks to be attached to the CPF section.

In order to reduce the impedance of the cable while maintaining its approximate diameter and voltage hold-off properties, the dielectric constant (or relative permittivity) of the insulating material can be increased. The impedance of a coaxial cable is given by $$Z = \frac{1}{2\pi}\sqrt{\frac{\mu_0}{\varepsilon_0\varepsilon_R}}\ln\left(\frac{R_o}{R_i}\right). \tag{7}$$

Since the impedance is proportional to $\varepsilon_R^{-1/2}$, the accelerator's 10.8-Ω cable can be decreased to 3.4Ω by increasing the dielectric constant from 2.3 (polyethylene) to 21. This also has the advantage of reducing the overall length of each cable while maintaining the 300-ns transit time for isolation purposes. Since the velocity of propagation also varies as $\varepsilon_R^{-1/2}$, a dielectric constant of 21 reduces the cable length from 60 m to 20 m. This also has the added benefit of reducing signal attenuation in the cable which is dependent on conductor losses and proportional to length.

A high dielectric constant polyethylene can replace the standard polyethylene used in the previously described cable. For example, this can be accomplished by impregnating the polyethylene with ceramic nanoparticles. Preliminary efforts have resulted in samples with dielectric constant of 21, but with reduced dielectric strength. The electric field in a coaxial cable is given by $$E = \frac{1}{\ln\left(\frac{R_o}{R_i}\right)}\frac{V}{r}. \quad (8)$$

Assuming a peak voltage of 120 kV, the maximum E-field in the present cable is 380 kV/m on the inner conductor ($r=R_i$). Testing of the loaded-poly samples revealed a dielectric strength of only ~200 kV/cm. An effort is currently underway to raise this strength to ~400 kV/cm in samples with a dielectric constant ranging from 9 to 21. Reducing the dielectric constant to 9 might result in better dielectric strength, although it would result in a 144-brick system with two, 5.4-Ω cables per brick.

Another way to obtain a low-inductance cable based on increasing the dielectric constant is to use deionized water (DI) as the insulating medium. To evaluate this concept a 50-Ω, air-dielectric cable filled with DI was tested. The cable was a 1-⅝" HJ7-0A Andrew Heliax® manufactured by CommScope, Inc. The cable is used in the telecommunications industry as a low-loss RF transmission line. It consists of an inner and outer corrugated copper conductor separated by a helical polyethylene spacer. COMSOL calculations indicate that a DI-filled Heliax has an impedance of 6.4Ω, ideal for a two-cable-per-brick arrangement. Based on velocity of propagation arguments, the DI cable only needs to be 10-meters long to provide the required 300-ns transit time, enabling an accelerator with 144 bricks. Further, an increase of the inner conductor radius by 0.5 cm decreases the cable inductance to 3.45Ω, enabling a one-cable-per-brick, 288-brick accelerator.

The various cable options are summarized in Table 1. A 144-brick accelerator is achievable either based on loaded poly or DI-Heliax cable. The performance of both the 144-brick and 288-brick accelerators can be determined using the same modeling approach and load configuration described above. For the 1-cm-wide by 2-cm-long panel arrangement and a 144-brick accelerator, a peak current of 5.4 MA with a peak pressure of 110 GPa are obtained. For a 288-brick accelerator a peak current of 6.9 MA with a peak pressure of 170 GPa are obtained. The results of all three accelerator configurations (96, 144, and 288 bricks) are summarized in Table 2. Note that an increase in efficiency is realized in the 144-brick and 288-brick systems as cable length, and therefore signal attenuation, is reduced.

TABLE I

Comparison of cable options to expand the number of bricks while maintaining impedance matching between bricks and cable.

| Type of cable | ε | $R_o$ (cm) | $R_i$ (cm) | Z (Ω) | Length (m) | $E_{max}$ (kV/cm) |
|---|---|---|---|---|---|---|
| standard | 2.3 | 1.63 | 1.27 | 10.8 | 60 | 380 |
| Nano-poly | 9 | 1.63 | 1.27 | 5.42 | 30 | 380 |
| Nano-poly | 21 | 1.63 | 1.27 | 3.55 | 20 | 380 |
| DI-Heliax | 80 | 2.32 | 0.90 | 6.40 | 10 | 141 |
| DI-Mod | 80 | 2.32 | 1.40 | 3.45 | 10 | 170 |

TABLE II

Comparison of load performance for 10-mm-wide panels with 96-, 144-, and 288-brick accelerators.

| Brick number | Cables per brick | Total E(kJ) | Peak I (MA) | Peak P (GPa) | Load e (kJ) | Efficiency (%) |
|---|---|---|---|---|---|---|
| 96 | 3 | 76.8 | 4.1 | 65 | 27.0 | 35 |
| 144 | 2 | 115 | 5.4 | 110 | 56.1 | 49 |
| 288 | 1 | 230 | 6.9 | 170 | 111 | 48 |

Circuitless Pulse-Tailoring of the Accelerator

As described above, pulse tailoring is desired to delay the onset of shocks in samples. Pulse shaping delays the intersection of loading characteristics. Ideally, the pulse shape can be tailored so that all characteristics intersect at a single "critical" location Xc. Given the equation-of-state of a material, ideal pressure waveforms can be calculated. On machines such as ZR, pulse tailoring is accomplished by individually triggering gas switches into 36 transmission lines. MHD and transmission-line codes are used to determine the sequence to produce the most optimal pulse for a specific experiment. Usually this involves hand-tuning trigger times in a circuit code unto the desired waveform is achieved. Critical to the process is an accurate circuit model which, in the case of ZR, contains over fifty thousand circuit elements.

With the variable-pulse-shape pulsed-power accelerator of the present invention, advantage can be taken of the transit time isolation of the bricks and the pulse can be determined without the use of a circuit or transmission line code. Essentially this involves using the brick current waveforms as basis functions to construct the desired configuration. The forward going power in any of the constant impedance identical coaxial lines is independent of the load, and of the other lines, for the time interval between the earliest triggered brick pulse arrival at the connecting point and the round trip electromagnetic transit time from that connecting point to that brick and back. Furthermore, given that the load is at a small radius, only the voltage average and the total current of all bricks need to be considered. See E. M. Waisman and A. Wilson, *J. Appl. Phys.* 53, 731 (1982). Therefore, a procedure was developed which does not need circuit calculations and uses the single-brick basis function to determine the brick-triggering sequence necessary to generate a highly tailored current-pulse time history for shockless loading of samples.

Using TEM waveguide theory, the equivalent total voltage and current can be expressed into forward and backward propagating waves $$V = V_+ + V_- \text{ and} \quad (9)$$

$$I = \frac{V_+}{Z} - \frac{V_-}{Z}. \quad (10)$$

This can be rewritten in terms of the forward propagating quantities $$V_+ = \frac{1}{2}(V + ZI) \text{ and} \quad (11)$$

-continued $$I_+ = \frac{1}{2}\left(\frac{V}{Z} + I\right). \tag{12}$$

Since the bricks are transit-time decoupled and the transmission lines are of constant impedance, the forward going current is the sum of all individual brick currents $$I_+ = \sum_{k=1}^{N} i_k(t - \tau_k) \tag{13}$$

where $\vec{\tau}=(\tau_1, \ldots, \tau_n)$ is the set of brick delay times and $i_k$ is the forward propagating brick current from the $k^{th}$ brick (an example of an $i_k$ waveform is given in FIG. 3). Using the desired ICE load voltage and current ($V_D$, $I_D$) and the inductance of the CPF beyond the load ($L_C$) the desired forward going current is $$I_{0+} = \frac{1}{2}\left[\frac{V_D + L_C \dot{I}_D}{Z} + I_D\right]. \tag{14}$$

An optimization procedure can then be used to determine a set of $\tau_k$ such that $I_{0+} \approx I_+$. This involves finding a local minimum to the $L_2$ norm given by $$F(\vec{\tau}) = \int_0^T dt[I_+(t) - I_{0+}(t)]^2. \tag{15}$$

Figure 14:
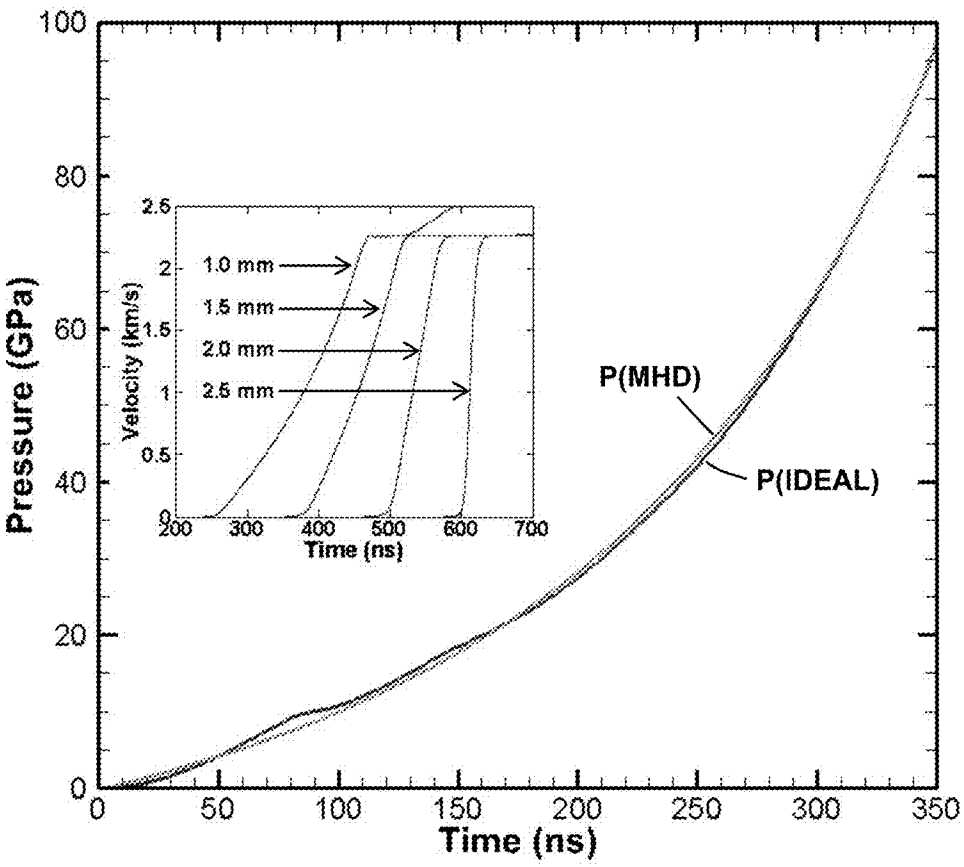
FIG. 14 is a graph of the ideal and MHD code-calculated pressure drive for shockless compression of copper. The inset shows copper-LiF interface velocities for the tailored pressure pulse. Ramp loading is maintained until sample thickness is $X_C$=2.4 mm.
Figure 15:
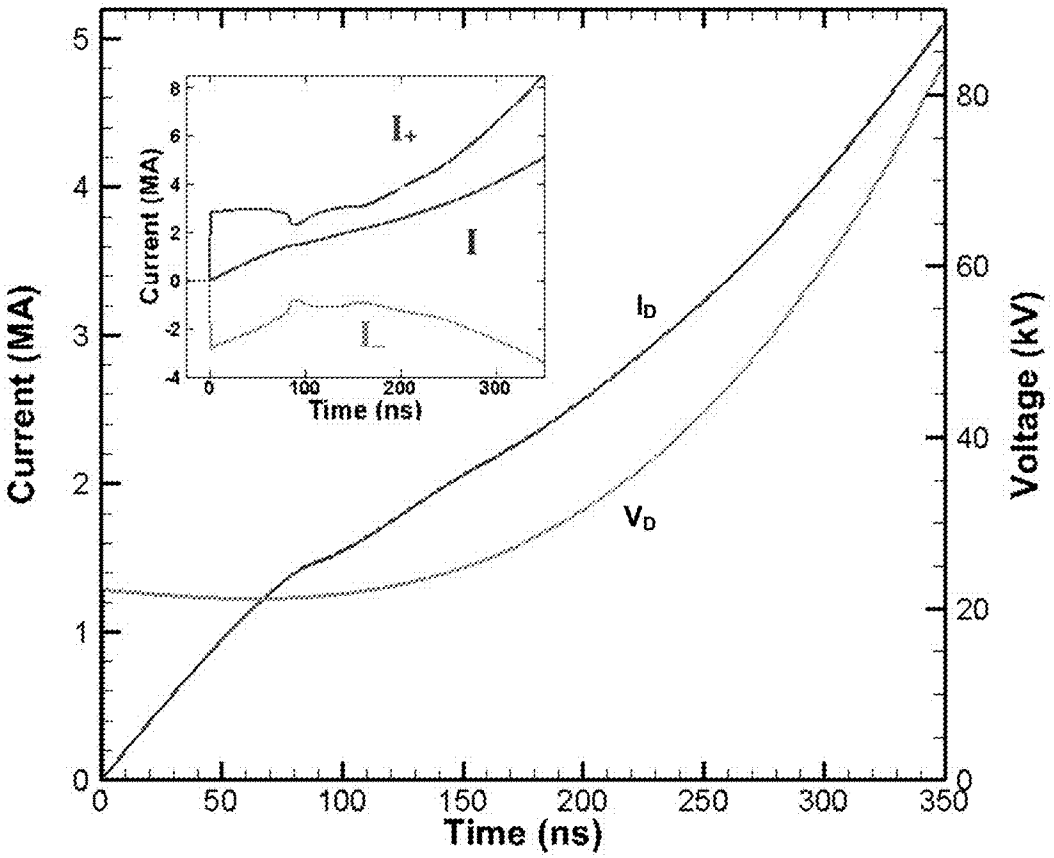
FIG. 15 is a graph of the desired current and voltage for compression of copper. Inset shows decomposition of current (I) into forward-going ($I_+$) and backward-going ($I_-$) waves.

A previous ICE load configuration, 1-cm-wide by 2-cm-long copper stripline panels was used as an example. First, the ideal pressure waveform P(t) for a ~100-GPa maximum pressure and 350-ns rise time that will ensure shockless loading up to the location $X_C$=0.24 cm was determined, as shown in FIG. 14. Second, the MHD code was used to iteratively determine the current $I_D(t)$ and voltage $V_D(t)$ that most closely reproduces the magnetic pressure given by $$P(t)=B^2(t)/2\mu_0 \tag{16}$$

where B(t) is the magnetic field magnitude in the center of the insulating gap between the two drive panels, as shown in FIG. 15. Third, the desired forward-going current that appears on the CPF section after the TEM wave has propagated through the coaxial transmission lines was determined using Eq. (14). In this case, the central-power-flow inductance is given by $L_C$=1.8 nH and the transmission line impedance is given by $$Z=Z_C/N_B \tag{17}$$

where $Z_C$ is the individual cable impedance and N is the number of bricks. Finally, $F(\vec{\tau})$ is formed according to Eq. (15), using the appropriate brick basis functions $i_k$, to find the local minimum. This provides an optimal set of delay times $\vec{\tau}$.

Figure 16:
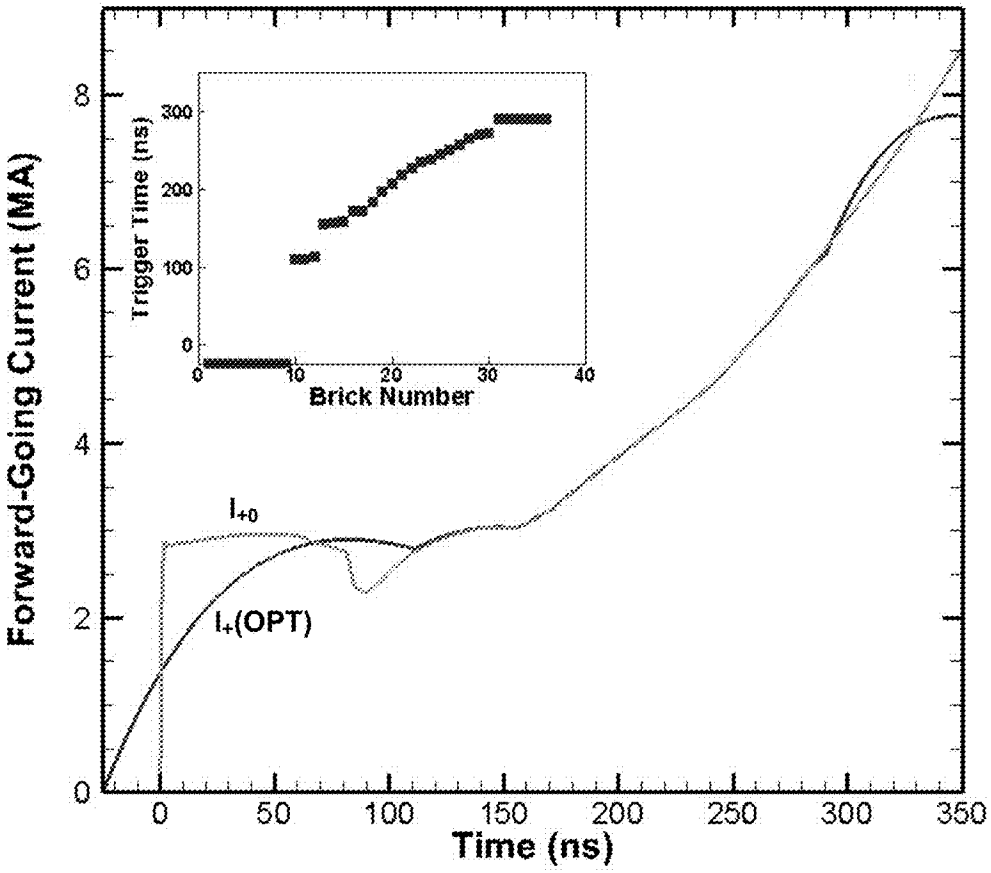
FIG. 16 is a graph of the optimized fit for forward-going current compared to desired forward-going current. Inset shows trigger times (τ) for 100 GPa Cu compression example with 36, independent trigger times and 288 bricks.
Figure 17:
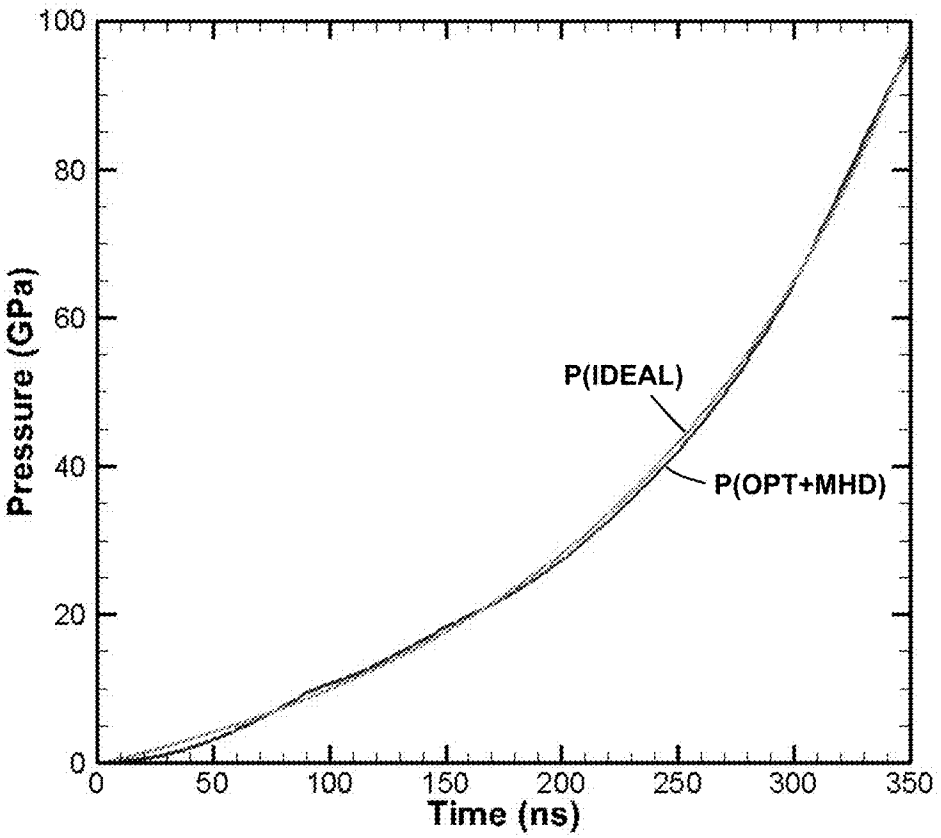
FIG. 17 is a graph of the pressure profile obtained by using the voltage from the optimization procedure in the MHD code compared to the ideal pressure pulse.

The results of the optimization procedure for a 288-brick system are shown in FIG. 16. A good fit is obtained between the desired forward-going current $I_{0+}$ the current produced by the optimized linear combination of brick currents $I_+(\vec{\tau})$. The results were achieved with 36, independent trigger times, as shown in the inset in FIG. 16. Some difficulty is encountered in matching the rapid early-time rise of the desired current, which is largely a result of the characteristics condition, to obtain the ideal isentropic-loading condition. However, good agreement is obtained between the pressure waveform produced by the optimization procedure, when computed with the MHD code, and the ideal pressure drive, as show in FIG. 17. Part of the optimization process is determining the number of bricks that are needed to produce the desired current and voltage waveforms. This was ultimately how a 288-brick system was chosen for this one-megabar example. An advantage of this technique is the ability to evaluate peak-pressure capabilities of accelerator configurations as a function of the number and type of bricks.

Impedance-Matched Accelerator

Figure 18:
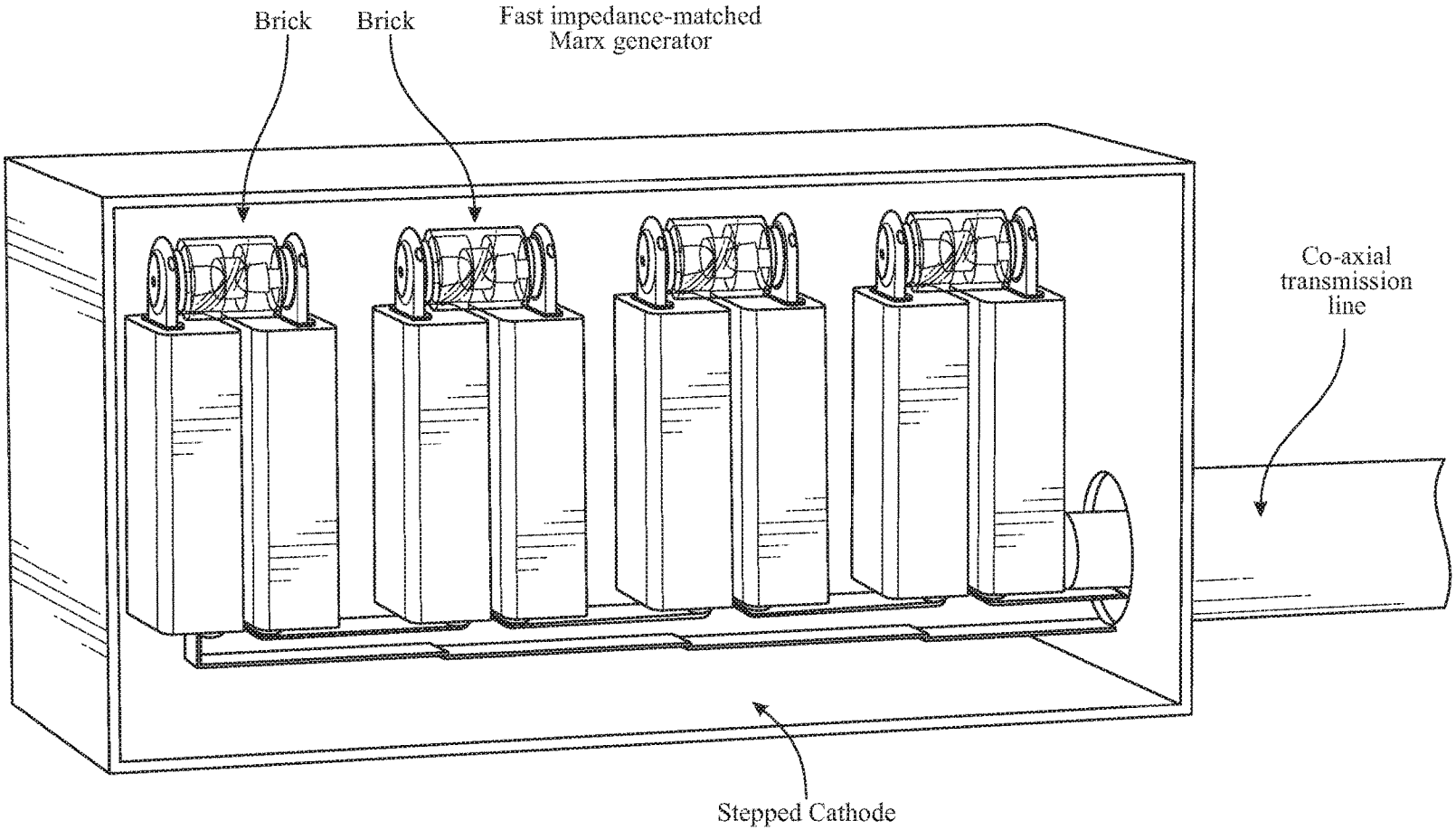
FIG. 18 is a schematic illustration of a fast impedance-matched MARX generator comprising four bricks as a stepped cathode.

Impedance mismatches within the accelerator can cause multiple reflections of the pulse, which reduces the power and energy efficiency of the accelerator and complicates accelerator design, maintenance, and operation. Reflections within the accelerator can be minimized by impedance matching the prime power source and transmission lines to the load. An impedance-matched accelerator that minimizes reflections can generate an arbitrary current-pulse waveform at the load with high accuracy, The current delivered to the load and, therefore, the peak magnetic pressure achievable in a materials physics experiment, can be further increased by using fast impedance-matched Marx generators as the LC drive circuit, rather than single bricks as described above. In FIG. 18 is shown a schematic illustration of a fast impedance-matched MARX generator. Each MARX consists of four bricks connected electrically in series. Each brick comprises two capacitors in series with a single gas switch. Each MARX generator can drive a coaxial transmission line. The anode-cathode gap of the MARX generator can be tailored so that the output impedance of the MARX generator matches the input impedance of the coaxial transmission line.

Figure 19:
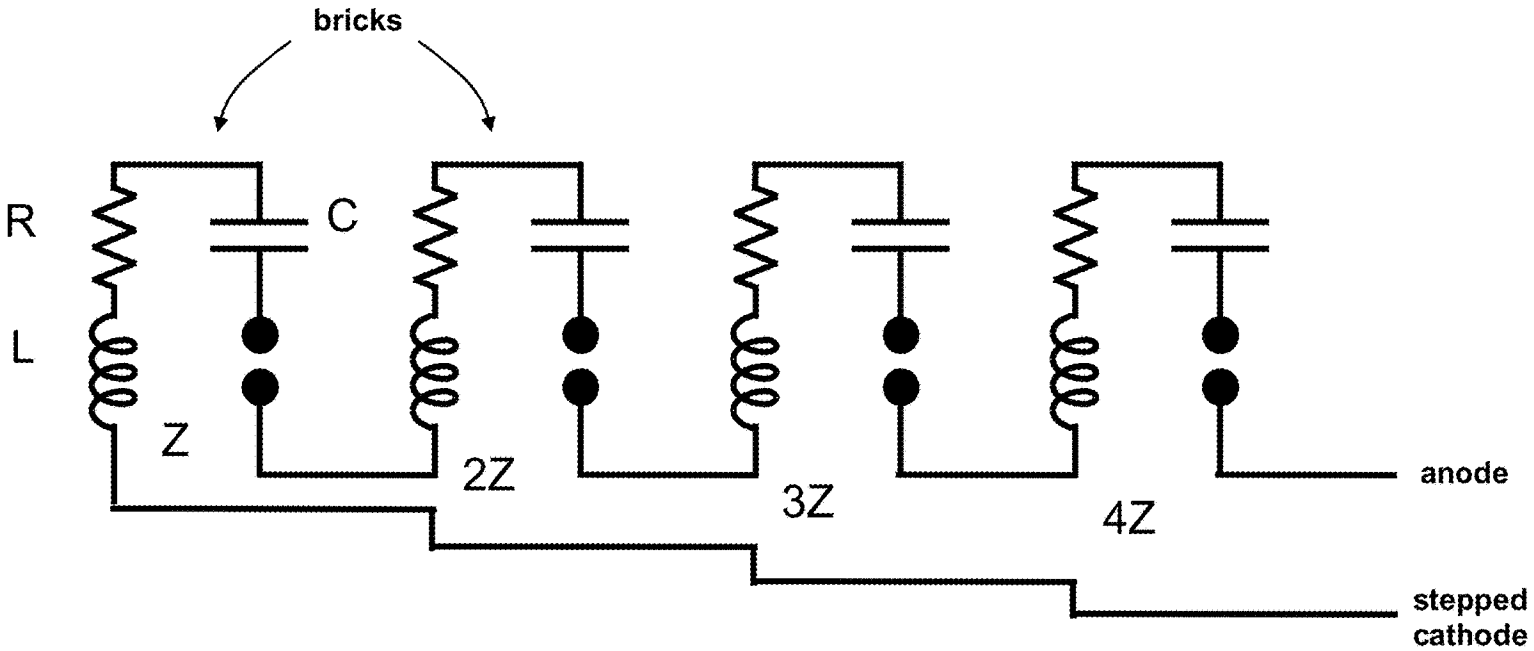
FIG. 19 is a circuit diagram for a four-brick MARX generator.

FIG. 19 is a circuit diagram for a four-brick MARX generator. The MARX generator is impedance matched to maximize system efficiency. To maximize peak electrical power at the output of the generator, the internal line must have an impedance profile that increases in linear stepwise manner from the upstream to the downstream end of the generator. This profile can be achieved with a stepped cathode (as shown), or a tapered cathode that approximates the stepped geometry. The Marx generator drives an internal water-insulated coaxial transmission line, the inner conductor of which serves as the cathode. Assume each MARX generator has an equivalent circuit with C=50 nF, L=150 nH, and R=0.2Ω. Therefore, according to Eq. (1), Z=2.07Ω. Because of the low LC time constant, the fast MARX generator can deliver current with a rise time of only about 60 ns. At a 100 kV capacitor charge voltage, each MARX stores 4 kJ.

Figure 20:
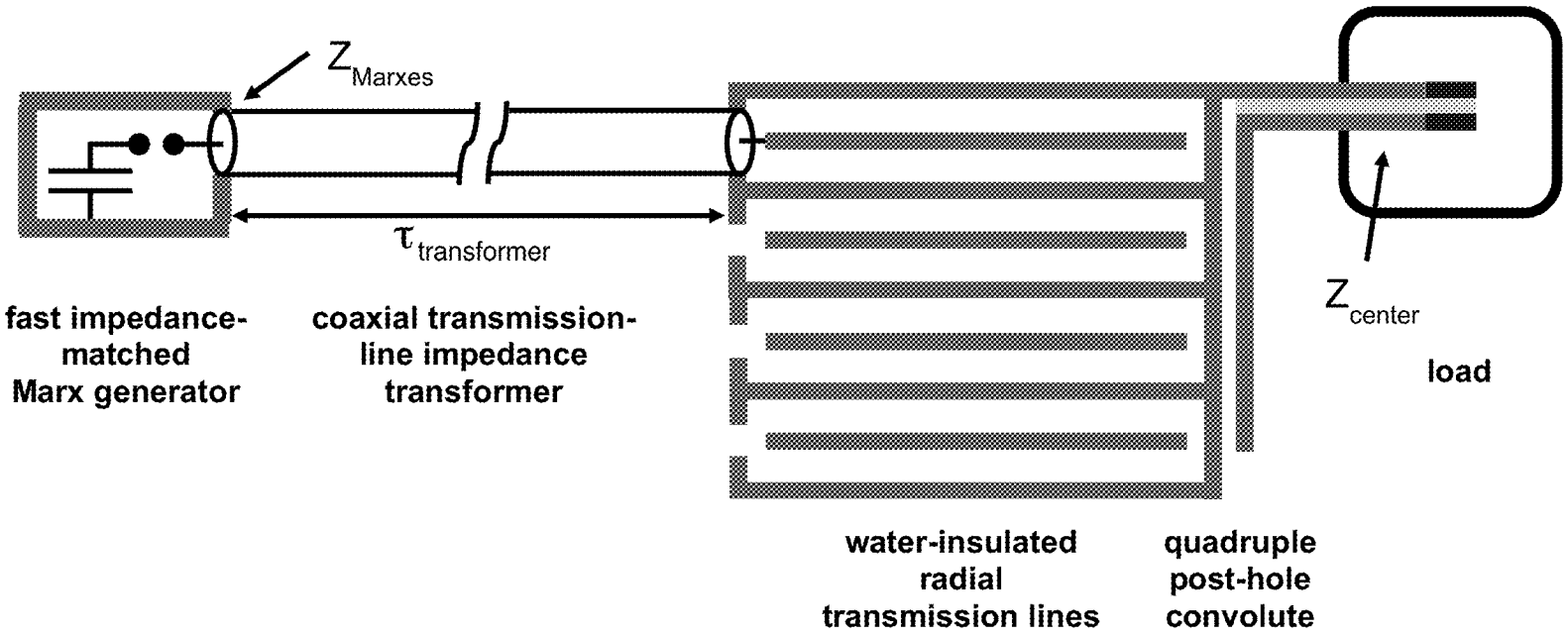
FIG. 20 is a schematic illustration of single pulse-forming circuit of a variable-pulse-shape pulsed-power accelerator comprising a fast impedance-matched MARX generator.

FIG. 20 is a schematic illustration of a single pulse-forming circuit of an impedance-matched variable-pulse-shape pulsed-power accelerator comprising four Marx generators each driving a long coaxial transmission line to decouple the Marx generators from each other (only one Marx generator is shown). Therefore, the coaxial transmission lines can have a one-way transit time, $\tau_{transformer}$, to create independent drive pulses. This transit-time isolation of the Marx generator provides flexibility in pulse shaping.

The output impedance of the Marx generator matches the input impedance of the transmission line to maximize the peak forward-going power delivered by the Marx generator. Therefore, the input impedance of each coaxial transmission line can be $Z_{in}=Z_{Marx}=4Z=8.26\Omega$. Likewise, the coaxial transmission lines can be impedance transformers that are impedance matched to the water-insulated radial transmission lines in the CPF section to minimize reflections in the system and maximize power delivered to a load. For example, the coaxial transmission-line impedance transformers can be rigid, water-insulated coaxial transmission lines having a DI water-filled annular spacing between the inner and outer conductors wherein the spacing varies with distance along the line. Therefore, the impedance can vary with distance along the line to provide output impedance, $Z_{out}$, that matches the input impedance of the water-insulated radial transmission lines. For example, the coaxial transmission-line impedance transformer can have a water-filled annular spacing between the inner to outer conductors that increases from the upstream to the downstream end of the line. For example, $Z_{out}$ can be about 13.2Ω to match the input impedance of the CPF section. In FIG. 20, the four coaxial transmission-lines impedance transformers (only one of which is shown) are connected in parallel to eight parallel water-insulated radial transmission lines that are connected to a quadruple post-hole water convolute. The convolute connects the eight radial transmission lines in parallel, combines the currents at the outputs of the transmission lines, and delivers the combined current to a centrally located load section.

Figure 21:
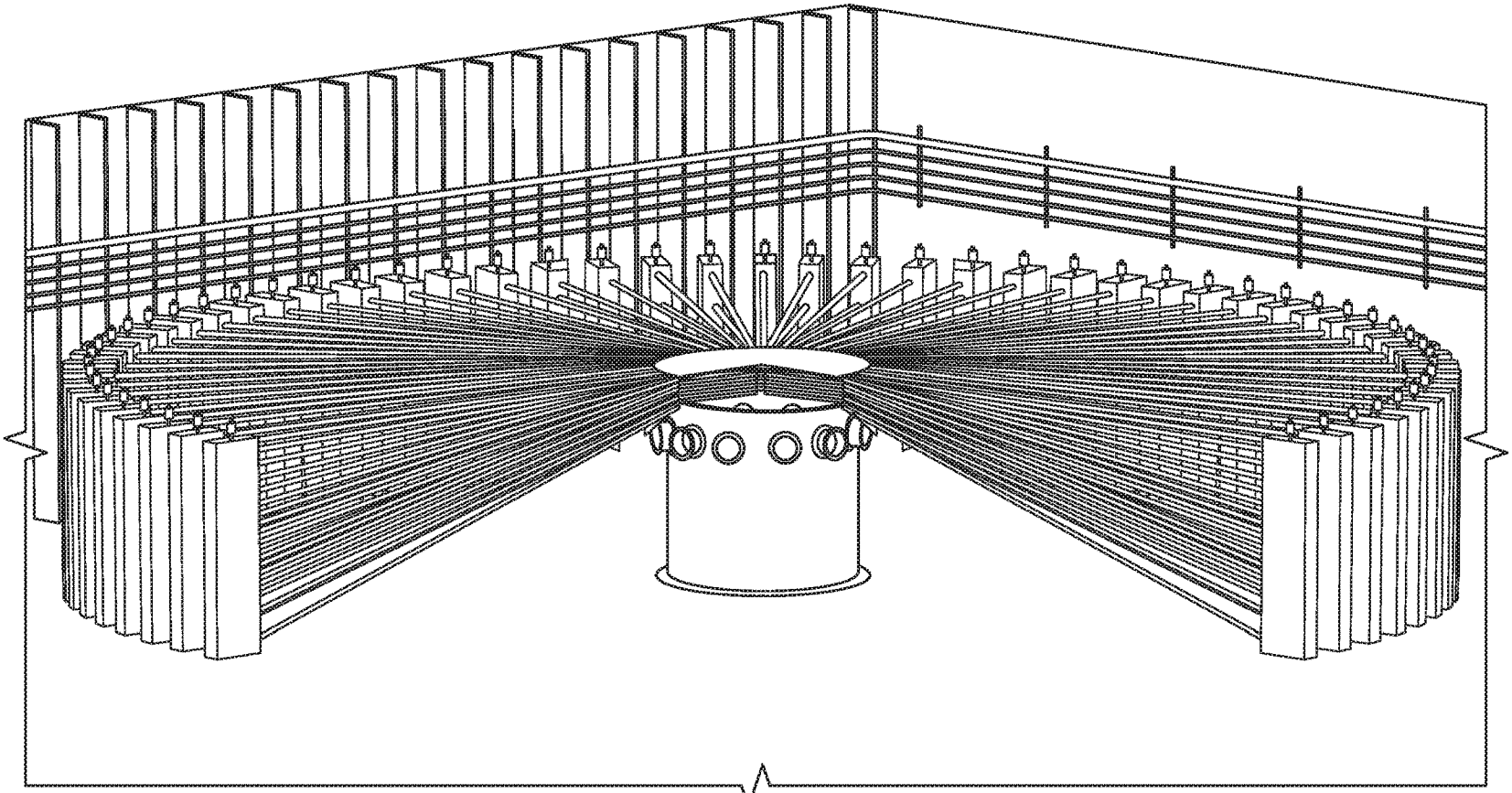
FIG. 21 is a schematic illustration of an impedance-matched, variable-pulse-shape pulsed-power accelerator.

FIG. 21 is a schematic illustration of an exemplary variable-pulse-shape pulsed-power-accelerator that uses single-stage pulse compression and is impedance matched throughout. The accelerator is driven by 600 fast impedance-matched MARX generators that serve as the prime power source of the accelerator. The Marx generators are stacked into 75 eight-Marx towers arranged azimuthally around the center of the accelerator. Each of the eight Marx generator levels drives a water-insulated coaxial-transmission-line impedance transformer, each of which in turn drives two water-insulated radial transmission lines that are connected to parallel water-insulated radial transmission lines by a multiple post hole convolute (not shown) in the CPF section of the accelerator. The 300-ns-long coaxial transmission-line impedance transformers transit-time isolate the Marx generators from each other. Therefore, the current pulse at the central load is a simple linear combination of 600 pulses. This accelerator can store 2.4 MJ of energy and generate 14 TW of peak electrical power. The accelerator can deliver 20 MA to a load in 400 ns. The accelerator is about 26 meters in diameter.

The present invention has been described as a variable-pulse-shape pulsed-power accelerator. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A variable-pulse-shape pulsed-power accelerator, comprising:

a plurality of low-inductance LC drive circuits that can be charged to a high voltage and be independently triggered to provide a plurality of power pulses;

a coaxial transmission line for each of the LC drive circuits that receives the power pulse from the LC drive circuit and are sufficiently long to transit time isolate each of the power pulses from the plurality of other power pulses; and a central-power-flow section comprising:

at least two water-insulated radial transmission lines that receive and combine the plurality of transit-time isolated power pulses from each of the coaxial transmission lines to form a radially converging power pulse; and a water-insulated post-hole convolute that connects the at least two water-insulated radial transmission lines in parallel at small radius to provide a variable shaped power pulse to a load.

2. The accelerator of claim 1, wherein each LC drive circuit comprises at least one brick, wherein each brick comprises two capacitors charged to opposite polarities with a triggered switch between the high voltage outputs of the two capacitors.

3. The accelerator of claim 2, wherein the LC drive circuits are stacked in brick towers comprising two or more vertically stacked bricks.

4. The accelerator of claim 2, wherein each LC drive circuit comprises a Marx generator comprising two or more bricks connected electrically in series.

5. The accelerator of claim 4, wherein the Marx generator is impedance matched to the input impedance of the coaxial transmission line.

6. The accelerator of claim 1, wherein the coaxial transmission line comprises one or more coaxial cables for each of the low-inductance LC drive circuits.

7. The accelerator of claim 6, wherein the coaxial cables comprise an inner and an outer conductor with ceramic-nanoparticle loaded polyethylene insulation therebetween.

8. The accelerator of claim 6, wherein the coaxial cables comprise an inner and an outer conductor with deionized water insulation therebetween.

9. The accelerator of claim 1, wherein the input of each of the coaxial transmission lines is impedance matched to the output of each of the LC drive circuits.

10. The accelerator of claim 1, wherein the coaxial transmission line comprises a water-insulated coaxial transmission-line impedance transformer having impedance that varies with distance along the line.

11. The accelerator of claim 10, wherein the output impedance of the water-insulated coaxial transmission-line impedance transformer is impedance matched to the input of the water-insulated radial transmission lines.

12. The accelerator of claim 1, wherein the at least two water-insulated radial transmission lines comprises four water-insulated radial transmission lines.

13. The accelerator of claim 12, wherein the four water-insulated radial transmission lines are connected by in parallel by a water-insulated double post-hole convolute.

14. The accelerator of claim 1, wherein the at least two water-insulated radial transmission lines comprises eight water-insulated radial transmission lines.

15. The accelerator of claim 14, wherein the eight water-insulated radial transmission lines are connected by in parallel by a water-insulated quadrupole post-hole convolute.

16. The accelerator of claim 1, wherein the load comprises a shorting current contact adapted so that the magnetic pressure of the variable shaped power pulse provides a ramped pressure pulse to a material sample.

* * * * *